US010788286B2

(12) United States Patent
Molina

(10) Patent No.: US 10,788,286 B2
(45) Date of Patent: Sep. 29, 2020

(54) PROTECTIVE SHROUD FOR FIREARMS WITH EXTERNAL RECIPROCATING MECHANISMS

(71) Applicant: Enrico Miguel Molina, Pleasant Grove, UT (US)

(72) Inventor: Enrico Miguel Molina, Pleasant Grove, UT (US)

( * ) Notice: Subject to any disclaimer, the term of this patent is extended or adjusted under 35 U.S.C. 154(b) by 0 days.

(21) Appl. No.: 15/991,888

(22) Filed: May 29, 2018

(65) Prior Publication Data

US 2018/0347933 A1 Dec. 6, 2018

Related U.S. Application Data

(60) Provisional application No. 62/513,108, filed on May 31, 2017.

(51) Int. Cl.

| | |
|---|---|
| ***F41A 35/04*** | (2006.01) |
| ***F41C 23/16*** | (2006.01) |
| ***F41A 21/44*** | (2006.01) |
| ***F41A 5/02*** | (2006.01) |
| ***F41A 35/02*** | (2006.01) |
| *F41A 21/36* | (2006.01) |

(52) U.S. Cl.

CPC ..... *F41A 35/04* (2013.01); *F41A 5/02* (2013.01); *F41A 21/44* (2013.01); *F41A 35/02* (2013.01); *F41C 23/16* (2013.01); *F41A 21/36* (2013.01)

(58) Field of Classification Search

CPC ..... F41A 21/34; F41A 21/32; F41A 21/44; F41A 5/12; F41A 35/04; F41C 23/16

USPC ..... 89/36.06; 42/96

See application file for complete search history.

(56) References Cited

U.S. PATENT DOCUMENTS

| | | | | |
|---|---|---|---|---|
| 1,530,877 | A | 9/1924 | Baer | |
| 1,989,448 | A * | 1/1935 | Hasselmann | F41A 3/72 42/106 |
| 5,479,736 | A * | 1/1996 | Forrester | F41A 1/06 102/430 |
| 5,563,362 | A * | 10/1996 | York | F41A 21/36 89/14.3 |
| 7,194,836 | B1 | 3/2007 | Urban | |
| 7,578,090 | B1 | 8/2009 | Romaszka | |

(Continued)

OTHER PUBLICATIONS

"For Sale: Custom Competition Bianchi Pistol .38 super", http://www.armslist.com/posts/2412795/oregon-handguns-for-sale--custom-competition-bianchi-pistol--38-super.

(Continued)

*Primary Examiner* — Stephen Johnson

(74) *Attorney, Agent, or Firm* — Workman Nydegger

(57) ABSTRACT

A shroud may include a hood component, faceplate component, floorplate component and/or other fitments which may partially or completely cover or extend beyond certain constituents of a firearm. Each of the components and fitments may include various functional and/or aesthetic features that prevent a firearm's reciprocating mechanism from malfunctioning by being moved out-of-battery, not cycling completely or being fouled by debris. Additionally, the components, fitments, functions and features improve: the distribution of weight on a firearm, the ability to grip and operate a firearm, and the options for using a firearm, both in its traditional and new alternative ways, collectively to enhance a firearm operator's defensive and/or combative capabilities.

18 Claims, 17 Drawing Sheets

(56) References Cited

U.S. PATENT DOCUMENTS

| | | | | |
|---|---|---|---|---|
| 7,735,255 | B1 * | 6/2010 | Kincaid | F41C 33/0254 362/110 |
| 8,590,198 | B2 | 11/2013 | Kasper | |
| 8,631,602 | B2 | 1/2014 | Chupp | |
| 9,057,580 | B2 * | 6/2015 | Rorick | F41C 33/0254 |
| 9,482,483 | B2 * | 11/2016 | Whelan | F41A 21/30 |
| 2012/0131829 | A1 * | 5/2012 | Fistikchi | F41A 3/72 42/1.06 |
| 2012/0204466 | A1 * | 8/2012 | Bayne | F41A 17/00 42/84 |
| 2017/0276453 | A1 * | 9/2017 | Lance | F41C 33/0254 |
| 2019/0226797 | A1 * | 7/2019 | Faifer | F41C 23/04 |

OTHER PUBLICATIONS

"Gilmore Sports Concepts 45 ACP Bianchi" https://www.gunsamerica.com/921083773/Gilmore-Sports-Concepts-45ACP-Bianchi.htm.

"Nine Ball NEO Strike Face Front Kit for Tokyo Marui 18C/17 Gas Blowback Airsoft Pistols" https://www.evike.com/products/54250.

* cited by examiner

PROTECTIVE SHROUD FOR FIREARMS WITH EXTERNAL RECIPROCATING MECHANISMS

CROSS-REFERENCE TO RELATED APPLICATIONS

This application claims the benefit of and priority to U.S. Provisional Patent Application Ser. No. 62/513,108 filed on May 31, 2017, and entitled "PROTECTIVE SHROUDING DEVICE FOR FIREARMS WITH RECIPROCATING MECHANISMS," which application is incorporated herein by reference in its entirety.

BACKGROUND

Field of Invention

The present invention relates generally to firearms accessories, and more specifically to novel after-market and/or original-equipment-manufacturer firearms, devices, apparatuses, accessories and components.

Background

Extremely Close-Quarters Armed Combatives (ECQAC) is a relatively young field of study which explores strategies, tactics and techniques for defending one's self against deadly-force attacks initiated from an extremely close range. ECQAC is a rapidly evolving discipline that has experienced the development, evolution and decline of several theories. Current best-practices are based on the presumption that effective ECQAC techniques must include both "hand-to-hand" and armed counteroffensive methods.

In real-world examples, the battlefields of Iraq and Afghanistan have involved a high incidence of close-quarter engagements in and around densely spaced urban structures. Additionally, military, police and intelligence personnel are often engaged in counter-terror and anti-crime operations, which tend to involve close-quarters engagements. Also of note, state-level training requirements to obtain concealed-carry weapons permits can often be grossly inadequate to appropriately handle ECQAC scenarios.

The net effect of these factors is that many warfighters, law enforcement/security personnel, and civilians are in need of improved ECQAC equipment to implement best-practices in training. Such training and equipment is not only designed to improve the armed individual's personal survivability, but also to minimize risk to innocent bystanders, ensure the most stringent rules of engagement and self-defense laws can be followed, and mitigate unjustified injuries or loss of life. Additionally, effective ECQAC equipment and technique must provide for the probability that violent attackers, whose actions may warrant the potential use of deadly-force, will likely come in physical contact with their intended-victim(s) and any weapons their intended-victim(s) may be carrying, such as a firearm.

Notably, the present invention may address numerous issues and scenarios related to firearms with external reciprocating mechanisms. For instance, such a reciprocating mechanism may be moved "out-of-battery" by an attacker (e.g., when an attacker grabs or an object or body part comes in contact with the reciprocating mechanism), resulting in a firearm that is inoperable. In another example, a firearm may malfunction when the reciprocating mechanism is grabbed or contacted by an object or person by preventing the firearm from completely cycling, resulting in an inoperable firearm when a shot is fired. In yet another example, reciprocating mechanisms may be fouled by debris or other obstructions that enter or interfere with critical areas of the firearm (e.g., ejection port, extractor, levers, and so forth). In addition to issues related to reciprocating mechanisms, various other issues may also be addressed by the present invention. For instance, taking one or more shots with a firearm in a stressful situation can be dangerous to bystanders, as recoil and poorly distributed weight on a firearm can reduce an individual's control of the firearm.

Therefore, a need exists in the field for novel after-market and/or original-equipment-manufacturer devices, features, extensions, apparatuses, accessories and integral components capable of protecting and sustaining the functionality of firearms with external reciprocating mechanisms. The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

At least some embodiments described herein relate to a shroud that is configured to connect to or be an integral part of a firearm having an external reciprocating mechanism. The shroud may be further configured to prevent such a reciprocating mechanism from moving out-of-battery (other than during normal cycling), or otherwise restrict the reciprocating mechanism from cycling completely, thus causing the firearm to malfunction. For example, the shroud may include one or more of a hood portion, a faceplate portion, a floorplate portion and other additional fitments and features. Notably, these components may be configured to permanently or temporarily connect to or disconnect from each other or any part of the firearm or be an integral part of the firearm's original production. In some embodiments, the hood portion and/or the faceplate portion may extend beyond a muzzle of the firearm.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 10B illustrates an example of a faceplate portion that is integrated with a floorplate portion, which could be mounted to a hood portion similar to that shown in FIG. 3, FIG. 4 and the like.

DETAILED DESCRIPTION

Figure 1:
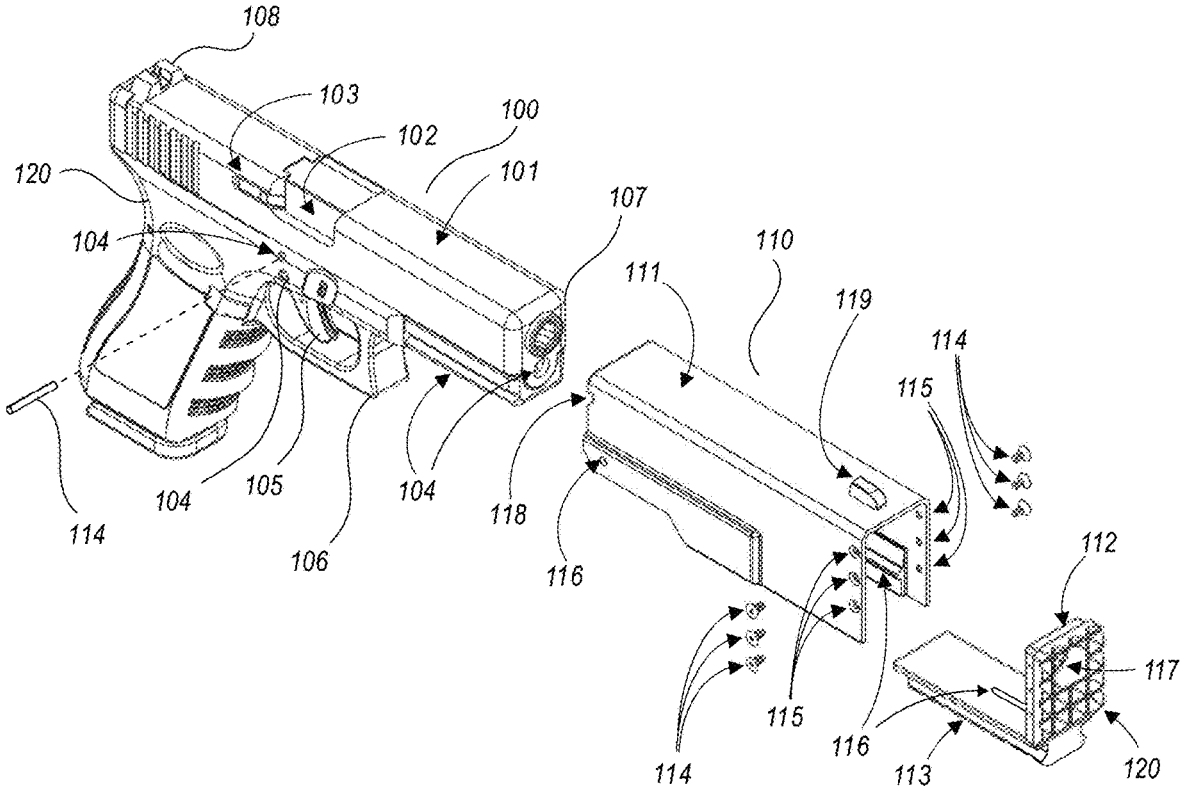
FIG. 1 illustrates an exploded view of a shroud and cooperating firearm.

Some embodiments described herein relate to a shroud configured to connect to a firearm having a reciprocating mechanism. The shroud may be further configured to prevent the reciprocating mechanism of a firearm from moving out-of-battery (other than when cycling normally) or otherwise be restricted from cycling completely, thus causing the firearm to malfunction. For example, the shroud may include one or more of a hood portion, a faceplate portion, a floorplate portion and/or other fitments. In some embodiments, the hood portion and/or the faceplate portion may extend beyond a muzzle of the firearm.

A shroud that can be coupled to a firearm or integrated within the firearm and may address numerous issues and scenarios related to reciprocating mechanisms of firearms. For instance, the shroud may prevent a reciprocating mechanism of a firearm from being moved out-of-battery (i.e., resulting in an inability to fire the firearm) or otherwise restricting the firearm from cycling completely in numerous scenarios. In at least one embodiment, a shroud may prevent an attacker from grabbing the reciprocating mechanism in such a way that causes the reciprocating mechanism to move out-of-battery or prevents it from cycling completely. In at least one additional or alternative embodiment, a shroud may prevent a reciprocating mechanism from being fouled by debris or other obstructions that enter or interfere with critical areas of the firearm (e.g., ejection port, extractor, levers, and so forth). In at least one additional or alternative embodiment, a shroud may prevent a reciprocating mechanism from moving out-of-battery or prevent it from cycling completely when the firearm is pressed against a person or object. In at least one additional or alternative embodiment, such shrouds may also beneficially distribute weight on a firearm to provide stability over the perceived recoil created when firing the firearm. Additionally, in at least one additional or alternative embodiment, a shroud may provide the porting and braking mechanisms used in compensators. As used herein, a compensator refers to a category of firearm accessories that direct the gas that exits a firearm's barrel in such a way that it reduces the amount of perceived recoil. Within conventional firearms, compensators have typically been directly attached to the firearm's barrel or reciprocating mechanism. Moreover, a shroud may provide additional ways to hold, grip and manipulate the firearm, which may improve shooting accuracy. A shroud may also provide additional weapon features that are separate from firing a firearm, including features that may be effective when using the firearm for impacting, piercing, cutting, slicing, gouging, scraping, electrical stunning and/or chemical spraying, and so forth. Furthermore, a shroud may provide ways to eliminate an attacker's grasp on a firearm by having methods of quickly detaching a shroud from a firearm being grasped by an attacker.

Some introductory discussion relating to issues related to the use of firearms will first be discussed. Then various shrouds and how they may be coupled to firearms for improving a firearm's utility and effectiveness will be described with respect to FIGS. 1-20B.

Many of the primary issues addressed by the present invention relate to preventing the disruption of how a firearm's reciprocating mechanism must cycle for the firearm to function properly. A reciprocating mechanism allows a firearm to chamber a round of ammunition, cock the firing mechanism, stage the trigger, allow the trigger to be released, fire the round, extract and eject the spent round from the firearm, and chamber another round in preparation to repeat the cycle. However, as further described herein, if the normal cycle of a firearm's reciprocating mechanism is disturbed, the firearm will malfunction. The reciprocating mechanism's cycle can be disturbed in a variety of ways, to include the following: i) an attacker could grab the reciprocating mechanism, ii) the operator could inadvertently hold the firearm incorrectly, iii) the firearm could come into contact with an object, structure or body part, iv) the reciprocating mechanism could be fouled by dirt, debris, clothing, and/or other obstructions that enter or interfere with critical areas of the firearm (e.g., an ejection port, an extractor and/or other openings, levers, and so forth), etc.

In all these scenarios, and others, the firearm can malfunction either because the firearm's reciprocating mechanism is moved out-of-battery or because it is prevented from completing its normal cycle. Such malfunctions may prevent the firearm from firing at all or may cause a malfunction at the time the firearm is fired. In yet another example, an intended-victim may inadvertently press the firearm against an attacker, resulting in the reciprocating mechanism moving out-of-battery (i.e., again preventing the firearm from firing). In still another example, an intended-victim may inadvertently place a body part(s) (e.g., a finger) on a reciprocating mechanism of the firearm, thus causing a malfunction of the firearm, as the reciprocating mechanism is restricted from completing its cycle. In yet another example, the reciprocating mechanism of the firearm can come in contact with clothing, structures, barriers and other objects that cause the firearm to malfunction, as the reciprocating mechanism is restricted from completing its cycle or is out-of-battery. In still another example, firearms with reciprocating mechanisms can be fouled by debris.

In addition, the present invention may also address a number of other issues related to a firearm's utility and effectiveness. For instance, an attacker, who is extremely close, may be able to harm and/or disarm an individual with a firearm. Through the novel features of the present invention, an individual having a firearm with the present invention may have the ability to use improved gripping, aiming, shooting, impacting, piercing, cutting, slicing, gouging, scraping, electrical stunning, and/or chemical spraying features and techniques, thus potentially giving the firearm's operator a significant advantage over his or her attacker, as further described herein. In scenarios where the firearm operator's best alternative is to get distance from an attacker, a shroud may provide ways to eliminate an attacker's grasp on a firearm by having methods of quickly detaching a shroud from a firearm being grasped by an attacker.

Furthermore, violent attacks, which legally and morally may warrant the use of potential deadly-force create extremely difficult situations for the intended-victim and/or intervening party (i.e., law enforcement officers, security guards, etc.). Controlling a firearm in these types of situations is complicated by the effects of stress, surprise, fear and the resulting release of adrenalin caused by these effects. Even well-trained and experienced shooters can find it difficult to control the influences that are exerted on and created by the firearm such as compromised sight alignment, trigger control and recoil management. The present invention mitigates the degradation of control over these factors by providing alternative ways to grip, aim, control and fire a firearm with a reciprocating mechanism. In one example, a shroud provides a firearm's operator with a greater ability to maintain possession and control of the firearm during a struggle, while defending himself or herself with hand-to-hand techniques that don't necessarily involve shooting. In another example, a shroud provides additional surfaces that may be gripped by the firearm's operator. These surfaces provide greater control and leverage of a firearm by allowing the firearm operator to use larger muscle groups, when small muscle control is compromised by higher than normal levels of adrenalin. This may improve a firearm operator's ability to aim accurately, manipulate the trigger properly and manage recoil adequately. Furthermore, the recoil effect may be minimized through the improved distribution of weight provided by a shroud, as further described herein.

Additionally, properly locating non-reciprocating, ballasting weight on a firearm may aid in dampening a firearm's perceived recoil, thus improving the operator's control of a firearm when firing one or more times. A shroud may also provide the porting and braking mechanisms used in compensators. This increased control over a firearm during an attack can reduce the likelihood of an errant shot. The complex shooting environments military, law enforcement, and civilian personnel are often forced to operate in frequently involve the presence of innocent bystanders. Any ability to improve a firearm operator's control in these situations can only serve to improve the safety of such bystanders.

In yet another example, encounters that have the potential to require deadly-force can be complicated by "reactive escalation" syndrome. Reactive escalation syndrome occurs when a confrontational chain of events between two or more parties begin with borderline actions (i.e., actions that could potentially be interpreted as either justifying or not justifying the use of deadly-force). In scenarios where the only method of defense is using a firearm in its traditional capacity, actions lead to increasingly aggressive reactions until a situation that might have deescalated to a non-deadly-force encounter becomes a de facto deadly-force level event. Notably, when the only option for using a firearm is to shoot, the likelihood of reactive escalation is more likely. As such, a firearm that includes alternative types of weapons (e.g., via impacting, piercing, cutting, slicing, gouging, scraping, electrical stunning, chemical spraying, and so forth) may reduce a likelihood of reactive escalation.

Accordingly, new shrouds, apparatuses, accessories and components for protecting and sustaining the functionality and enhancing the utility of firearms with reciprocating mechanisms are discussed herein. In the following description, for purposes of explanation, numerous specific details are set forth in order to provide a thorough understanding of the present invention. It will be evident, however, to one skilled in the art, that the present invention may be implemented and/or utilized without all of these specific details, but in some cases may only comprise one or more of the illustrated components.

For instance, FIG. 1 illustrates an exploded perspective view of a firearm 100 having a reciprocating mechanism 101, an ejection port 102, an extractor 103, and mounting surfaces 104, a trigger 105, a trigger guard 106, a muzzle 107, and rear sight 108. Notably, while a particular type of firearm 100 is shown herein, virtually any type of firearm having a reciprocating mechanism may be utilized to practice the principles described herein. As shown, FIG. 1 also includes a shroud 110 that, when coupled to the firearm 100, is configured to allow the firearm's reciprocating mechanism to move freely throughout an entire cycle of the reciprocating mechanism. More specifically, the shroud may at least partially cover the reciprocating mechanism 101, such that an attacker of an operator of the firearm may have less surface area with which to impede the progress of the reciprocating mechanism throughout the reciprocating mechanism's cycle.

As illustrated, the shroud 110 includes a hood 111, faceplate 112, and floorplate 113. The hood 111 may be particularly important for protecting the reciprocating mechanism from various impediments to completing the reciprocating mechanism's cycle. In particular, the hood 111 allows the reciprocating mechanism 101 of the firearm 100 to move freely throughout an entire cycle of the reciprocating mechanism by providing a protective barrier that surrounds all or part of the reciprocating mechanism and any attachments thereto. In an example, the hood 111 may be at least partially responsible for preventing an attacker from grabbing the reciprocating mechanism of the firearm, thus causing the reciprocating mechanism from moving out-of-battery or otherwise restricting the firearm from cycling completely. Notably, the hood 111 may be an integral part of the firearm 100 or coupled to the firearm 100 at any of a variety of mounting positions 104 and/or connection points, including but not limited to a frame 120, stock, chassis, barrels, barrel extensions, guide rods, rails, housings, threadings, accessory interfaces, and so forth of the firearm 100. In addition, the hood 111 may be coupled to any other applicable firearm accessory, bracket, support, fixture, and so forth that is temporarily or permanently and directly or indirectly attached to the firearm 100 (or held by or directly/indirectly connected to an operator of the firearm).

Figure 2A:
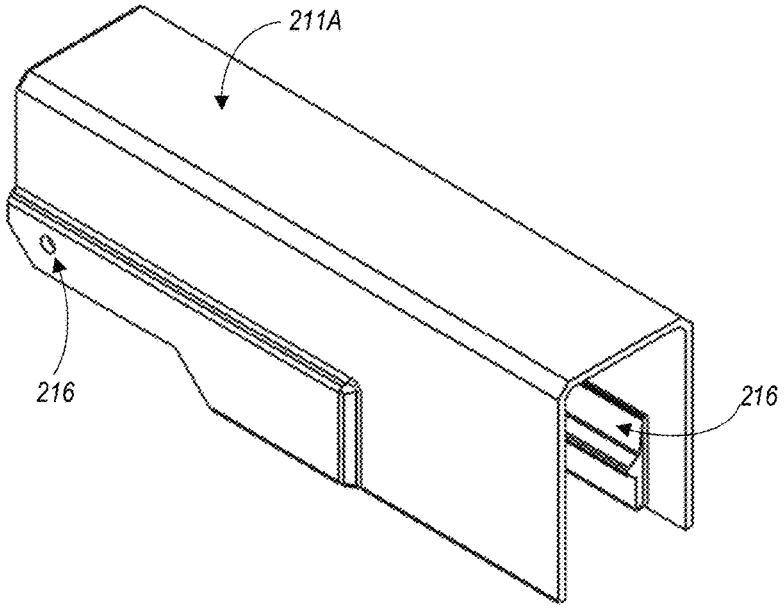
FIG. 2A illustrates an example of a shroud comprising a hood.
Figure 2B:
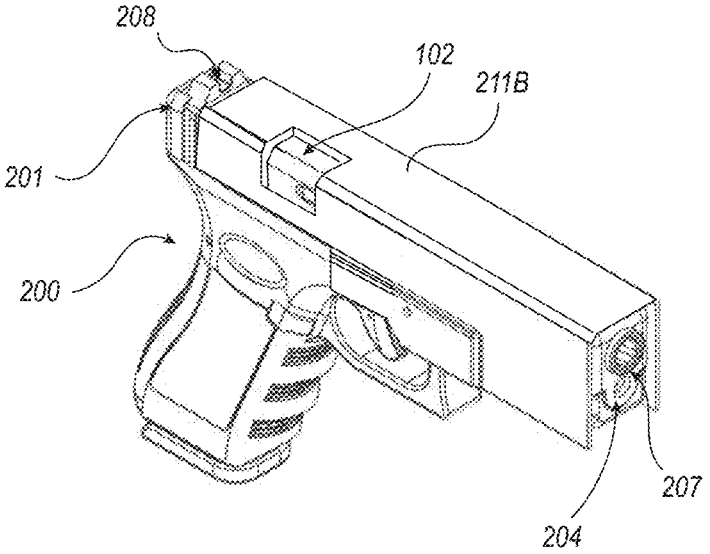
FIG. 2B illustrates an example shroud, without a faceplate, connected to a cooperating firearm.
Figure 2C:
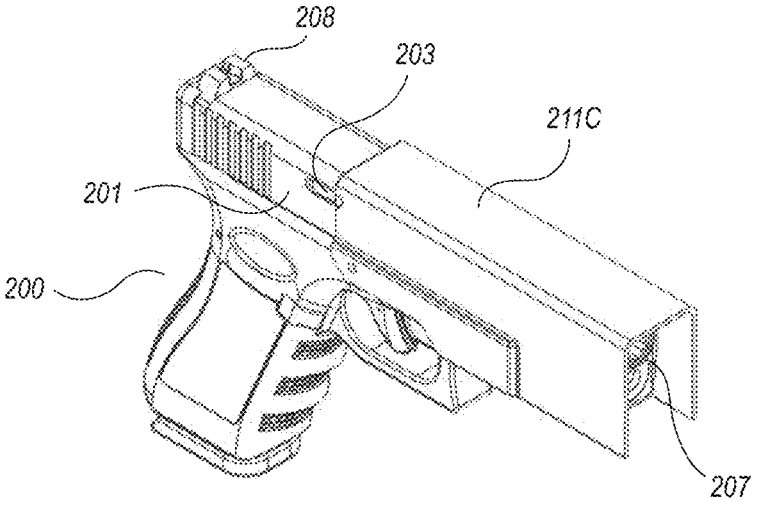
FIG. 2C illustrates another example shroud without a faceplate connected to a cooperating firearm.

FIGS. 2A-2C illustrate various embodiments of hoods (e.g., the hood 111) that can be attached to the firearm 100. For instance, FIG. 2A depicts a perspective view of the hood 211A having attachment features 216 that may be used to attach the hood 211A to the mounting surfaces 104 of the firearm 100, as further described herein. FIG. 2B illustrates a hood 211B that has been coupled to the firearm 200 and extends from a location at, or near, the muzzle 207 of the firearm 200 to a location at, or near, the rear sight 208 of the firearm 200. As shown in FIG. 2B, the hood 211B may be at least partially open to allow an individual to grip a portion of the reciprocating mechanism 201 in order to cock the firearm 200. Notably, in other embodiments, the hood 211B may be more or less open, subject to additional fitments which may be added to the firearm 200 and to facilitate cocking. In addition, the extended hood 211B has an opening to allow for ejecting shells via the ejection port 102. Notably, while a particular design that includes the hood extending from the area at or near the muzzle of the firearm to the area at or near the rear sight 208 of the firearm 200 is illustrated in FIG. 2B, virtually any design that includes the hood extending back from the area at or near the muzzle of the firearm and allows for both gripping a portion of the reciprocating mechanism 201 or an attachment to the reciprocating mechanism 201 which can be used to cock the firearm 200 and allows for ejecting shells may be utilized.

FIG. 2C illustrates yet another embodiment of a hood (i.e., hood 211C). As illustrated, the hood 211C is attached to the firearm 200 and extends past the muzzle 207 of the firearm. In such embodiments, the hood 211C may prevent an operator from inadvertently pressing the firearm against an object (e.g., an attacker), resulting in the reciprocating mechanism moving out-of-battery (i.e., preventing the firearm from firing). In other words, the hood 211C extending past the muzzle 207 may prevent the reciprocating mechanism 201 of the firearm 100 from moving out-of-battery even when no faceplate is coupled to the hood 211C and the firearm is pressed against another object near the muzzle. In some embodiments, the hood 211C may extend beyond the muzzle 207 within a range of 0.01 mm to 35.00 cm.

Notably, however, a faceplate (i.e, 112 of FIG. 1) may also be used for the same purpose (i.e., preventing an operator of the firearm from inadvertently pressing the firearm against a person or object, resulting in the reciprocating mechanism moving out-of-battery), as further described herein. In particular, a faceplate (i.e, 112 of FIG. 1) may extend past the muzzle to perform the same function as the hood 211C that extends past the muzzle. Returning to FIG. 1, in some embodiments, the faceplate 112 may extend from a position near or in front of the muzzle 107 to any position behind the muzzle 107 along the reciprocating mechanism 101 such that the faceplate 112 wraps at least partially around the reciprocating mechanism 101 to function similarly to a hood 111. Accordingly, in such embodiments, a hood portion 111 may connect another hood portion 111 or a faceplate portion 112 of a shroud and may be relatively short and extend only to the other portion of a shroud 110.

While the features of the hood 111, the hood 211A, the hood 211B, and the hood 211C are each shown separately, any combination of the features described herein may be used together. For instance, a hood that extends from a location forward of the muzzle 207 (e.g., the hood 211C) to a furthermost back portion of the firearm 200 (e.g., the hood 211B) may be utilized when practicing the principles described herein.

Figure 3:
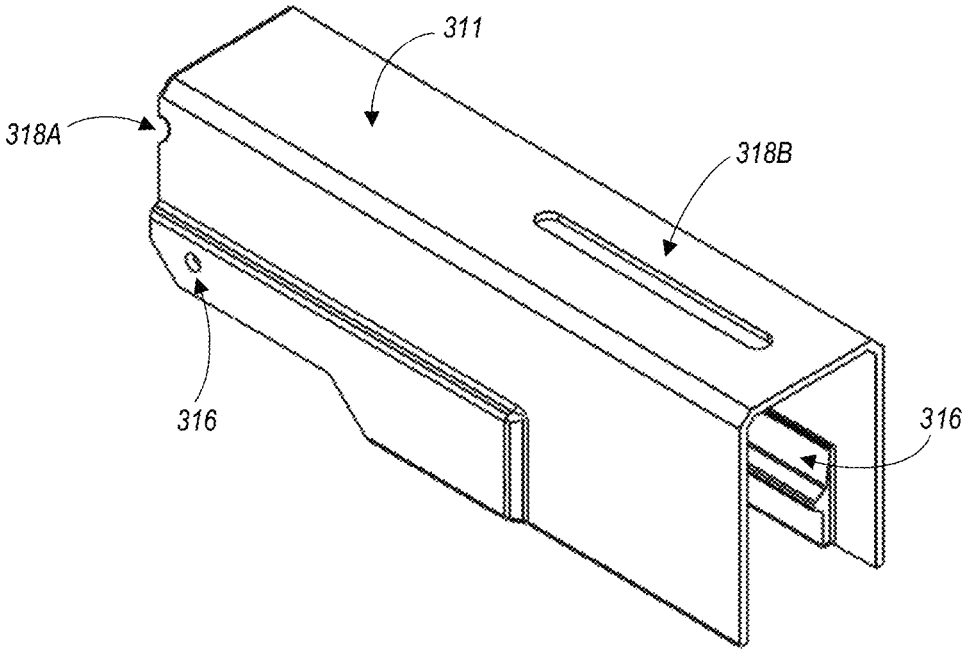
FIG. 3 illustrates another example of a hood portion of a shroud with an access feature.
Figure 4:
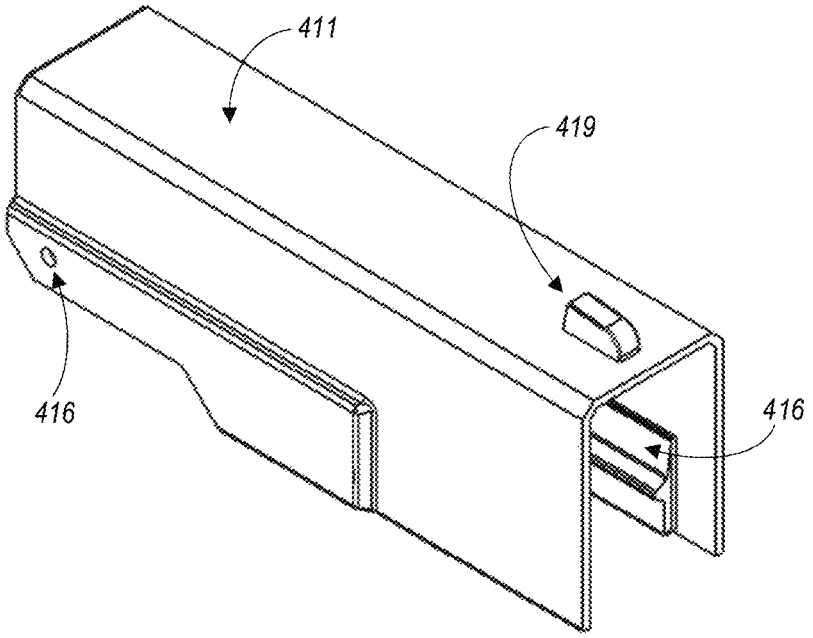
FIG. 4 illustrates another example of a hood portion of a shroud with a fitment.

In addition, a hood may be configured to provide various features that allow accessories to be attached to the hood/shroud and would perhaps otherwise be included on a surface of the firearm 200 without the hood or shroud. Notably, such accessories may be proprietary to a hood/shroud or may be accessories which may otherwise be directly or indirectly attached to a firearm (e.g., the firearm 200). In an example, FIG. 3 depicts a perspective view of a hood 311 having a first access feature 318A, a second access feature 318B, and the attachment features 316. In another example, FIG. 4 illustrates a hood 411 having a fitment 419. In particular, FIG. 4 depicts a perspective view of the hood 411, the fitment 419 that comprises a front sight (which would normally be attached directly to the firearm) and attachment features 416.

Returning to FIG. 1, the shroud 110 also includes the faceplate 112. As briefly described, the faceplate 112 may prevent an operator from inadvertently pressing the firearm against a person or object (e.g., clothing, a door frame, an attacker, etc.), resulting in the reciprocating mechanism moving out-of-battery (i.e., preventing the firearm from firing) or preventing it from cycling completely (i.e., resulting in the firearm malfunctioning). In other words, the hood 111 and/or the faceplate 112 extending past the muzzle 107 may prevent the reciprocating mechanism 101 of the firearm 100 from moving out-of-battery even when the firearm 100 coupled to a cooperating shroud 110 is in contact with another person or object near the muzzle 107. Additionally, the hood 111 and/or the faceplate 112 covering all or part of the reciprocating mechanism 101 of the firearm 100 may prevent the reciprocating mechanism 101 of the firearm 100 from not cycling completely even when the firearm 100 coupled to a cooperating shroud 110 is in contact with a person or object near the other surfaces of the reciprocating mechanism 101. Notably, the total or partial encapsulating effects of the hood 111 and/or the faceplate 112 make it possible for operators to hold, grip and manipulate the firearm 100 in ways that were previously not possible and have led to the development of techniques which can provide law enforcement, security, military, civilian personnel and the like with significantly higher odds of surviving extremely close-quarters attacks.

Figure 5A:
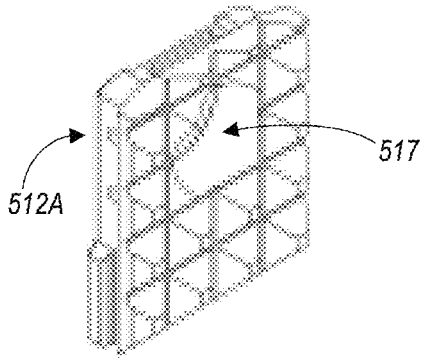
FIGS. 5A through 5H illustrate various examples of faceplate portions of a shroud as an individual component.
Figure 5B:
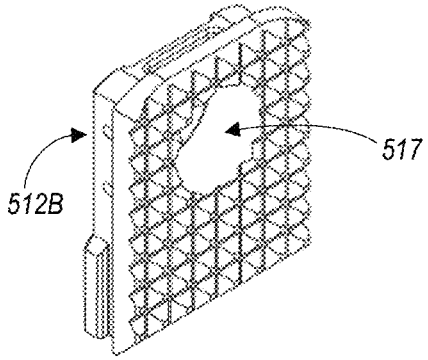
Figure 5C:
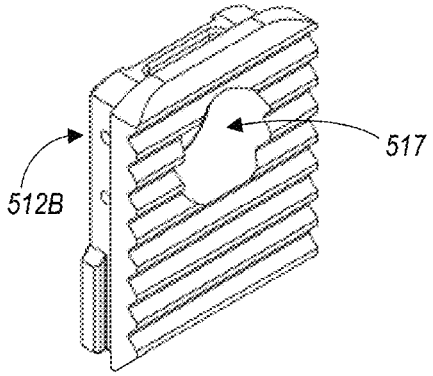
Figure 5D:
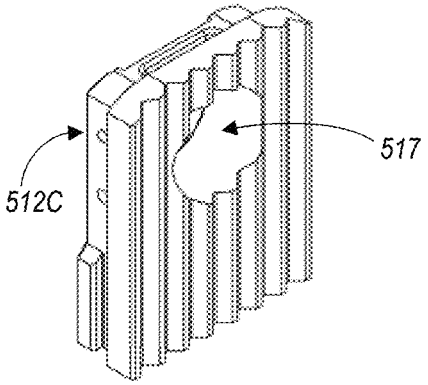
Figure 5E:
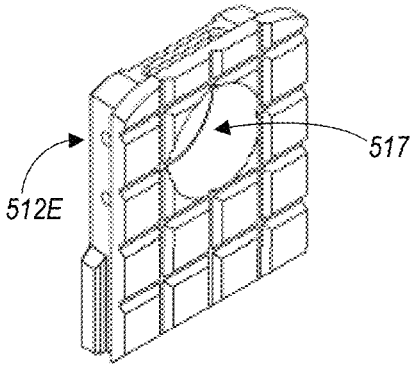
Figure 5F:
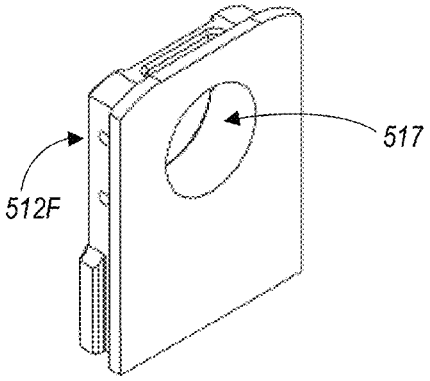
Figure 5G:
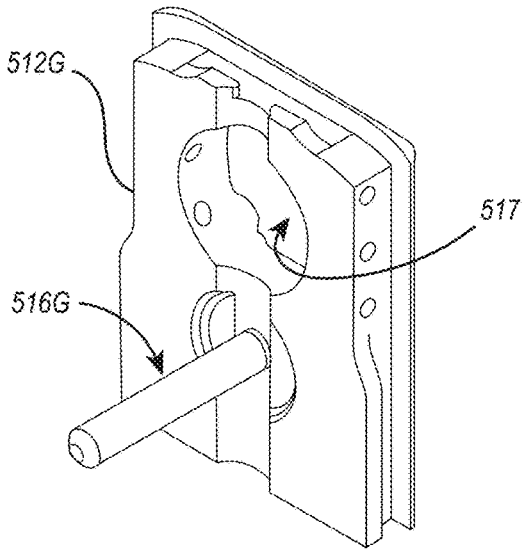
Figure 5H:
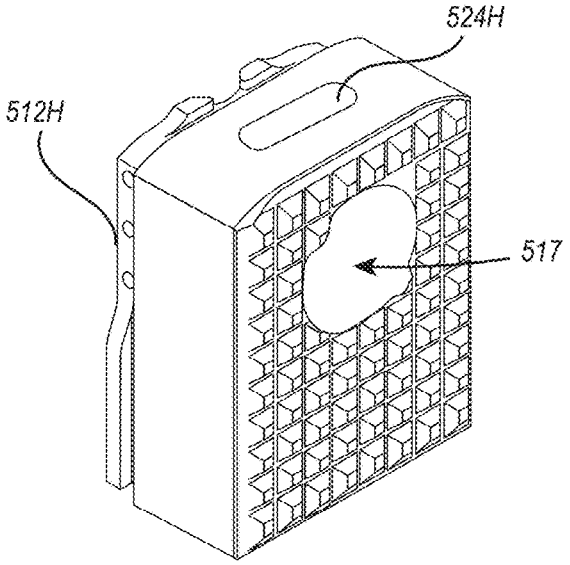

Faceplates described herein may be permanent or interchangeable and comprise various designs, features, and/or element(s) for either aesthetic (e.g., designs, reliefs, etchings, three-dimensional sculptings, and so forth) and/or functional purposes. More specifically, the outward-facing surfaces of a faceplate may be textured, profiled, elevated and/or relieved to include features, and/or attachments that improve impacting, piercing, cutting, slicing, gouging, scraping, electrical stunning and/or chemical spraying capabilities of a firearm. For instance, FIGS. 5A through 5F depict perspective views showing six examples of various aesthetic and/or functional design features that may be used with respect to a faceplate (e.g., faceplate 512A through faceplate 512F). FIG. 5G depicts a perspective view of the rear of one example of a faceplate showing an attachment feature 516 which can be used to couple a shroud to a mounting surface (e.g., the mounting surfaces 204 of FIG. 2B) on a firearm 200. One will appreciate, however, that this is only an example of a means to attach a shroud and/or a faceplate to a firearm. In additional or alternative embodiment, a number of different or additional means for attachment may be used.

Faceplates described herein (e.g., faceplate 112 of FIG. 1 and faceplates 512A through 512H of FIGS. 5*a* through 5H) may also include one or more openings through which one or more projectiles may pass in any combination (i.e., bullets, shot pellets, wads, slugs and so forth). Notably, the muzzle opening 117 (with respect to FIG. 1) or muzzle opening 517 (with respect to FIGS. 5A through 5H), may vary in size. In one example, the muzzle opening 117 or 517 may be comprised to accommodate various components of ammunition. In another example, the muzzle openings 117 of FIG. 1 and 517 of FIGS. 5A through 5H may be comprised to accommodate various accessories (e.g., compensators), features of a firearm (e.g., barrel threadings) and/or other components. In yet another example, the muzzle opening 117 or 517 may be comprised to accommodate additional functionality which is integral to a faceplate (e.g., muzzle brake features, flash suppressor features, recoil compensator features, sound suppressor features, and the like.) In other words, faceplates 512(A-H) may have integrated features and functionality of other firearm components and accessories, such as muzzle brakes, flash suppressors, recoil compensators, sound suppressors and the like.

Additionally, faceplates may be coupled to a firearm (or other portions of a shroud, such as a hood) using a variety of mounting positions and/or connection points, including but not limited to a frame, stock, chassis, barrels, barrel extensions, guide rods, rails, housings, threadings, accessory interfaces, and so forth of the firearm 100 or other firearm accessories, brackets, and/or other fixtures that are temporarily or permanently and directly or indirectly attached to the firearm 100 (or held by or directly/indirectly connected to an operator of the firearm). The ability to couple the faceplate either directly or indirectly to the frame (i.e., mounting surfaces other than the barrel or reciprocating mechanism) provides additional recoil management capabilities (i.e., functionality of muzzle brakes, compensators, ported barrels, and the like). When a firearm fires, gases are expelled from the firearm's muzzle 107. These gases impact may against one or more features on the faceplate 112 (i.e., the rear of the faceplate, other rear facing surfaces, such as ports and/or compensator slots 524H of FIG. 5H and may redirect gases, and thereby may reduce the perceived recoil.

Figure 6A:
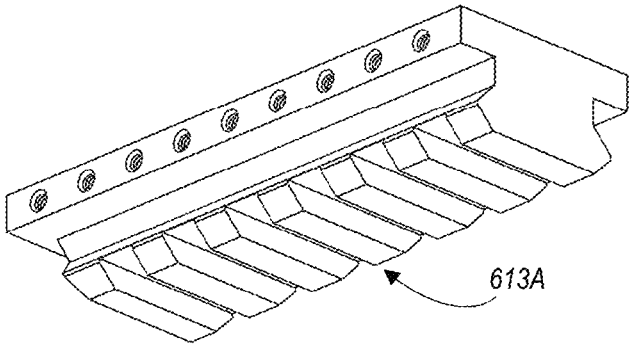
FIGS. 6A through 6C illustrate various examples of floorplate portions of a shroud as an individual component.
Figure 6B:
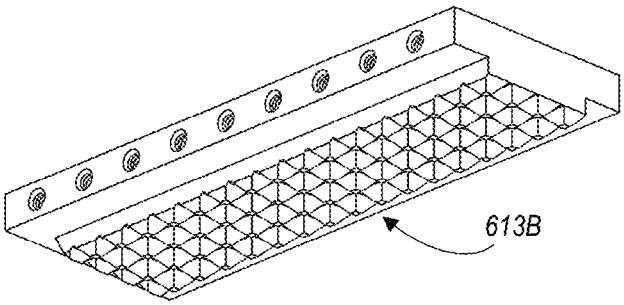
Figure 6C:
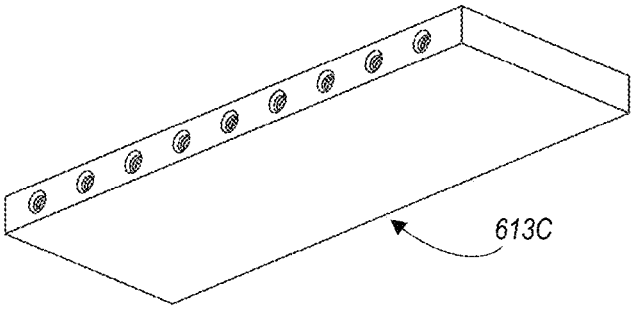

Returning to FIG. 1, the shroud 110 also includes the floorplate 113. The floorplate 113 may be permanent or interchangeable and comprise various designs, features, and/or element(s) for either aesthetic (e.g., designs, reliefs, etchings, three-dimensional sculptings, and so forth) and/or functional purposes. For instance, outward-facing surfaces of a floorplate 113 may be textured, profiled, elevated and/or relieved to include features and/or attachments that improve impacting, piercing, cutting, slicing, gouging, scraping, electrical stunning, and/or chemical spraying capabilities of the floorplate 113 and/or the firearm 100 to which the floorplate is attached. In more specific examples, FIGS. 6A through 6C depict perspective views showing three examples of aesthetic and/or functional design features of floorplates (i.e., floorplate 613A through floorplate 613C).

Additionally, floorplates 113 may be coupled to a firearm 100 (or other portions of a shroud, such as a hood or faceplate) using a variety of mounting positions and/or connection points, including but not limited to a frame, stock, chassis, barrels, barrel extensions, guide rods, rails, housings, threadings, accessory interfaces, and so forth of the firearm, or other firearm accessories, brackets, or fixtures that are temporarily or permanently and directly or indirectly attached to the firearm (or held by or directly or indirectly connected to an operator of the firearm). Some embodiments of a floorplate 113 may be configured to accommodate or adjust the mounting of devices, apparatuses, accessories and/or other attachments for the firearm 100.

While the hoods, faceplates, floorplates, and other components of the device may be described or shown herein as single or multiple elements, those skilled in the art will understand that such components may be unitarily formed alone or in combination with other components, or may comprise assemblies of multiple subcomponents, or may be integral features of firearm created during its original manufacturing while being collectively referred to as an individual component of a shroud or firearm.

Notably, the hood 111, the faceplate 112, and/or the floorplate 113 may be connected to each other by any individual or combination of joinery profiles, such as tongue-and-groove, dovetail, mortise-and-tenon, lap, splined, and so forth. In some embodiments, the hood 111, the faceplate 112, and/or the floorplate 113 may also be fastened together using any combination of pins, screws, bolts, cams, welds, threadings, bonding agents, adhesives and so forth (i.e., collectively referred to herein as fasteners 114). Accordingly, any individual or combination of pins, screws, bolts, cams, welds, joints, threadings, bonding agents, adhesives and the like may be used to connect any components of, subassemblies of, or the entirety of the shroud to a firearm or of the firearm itself. Additionally, hoods, faceplates and/or floorplates may be molded, cast, forged, stamped, milled, extruded, or otherwise unitarily formed together (i.e., integrated) as subassemblies or as one component.

In other embodiments, the hood 111, the faceplate 112, and/or the floorplate 113 may not be directly coupled together. For instance, each of the hood 111, the faceplate 112, and/or the floorplate 113 may be individually coupled to the firearm 100 or integrated into its original manufacturing. Accordingly, the hood 111, the faceplate 112, and the floorplate 113 may be individually or collectively coupled either directly or indirectly to the firearm. In particular, the hood 111, the faceplate 112, and the floorplate 113 may be coupled to any combination of accessories, brackets, or other supports of the firearm 100 (i.e., collectively referred to herein as mounting surfaces 104). The mounting surfaces 104 may be temporarily or permanently and directly or indirectly coupled to the firearm 100 or a feature of the firearm 100.

Features and/or surfaces used to connect the shroud 110 to the mounting surfaces 104 may include, but are not limited to, fastener apertures 115, contours, reliefs, wedges, threadings, press fit surfaces, clamping elements, trigger pins, retaining pins and/or the like (i.e., collectively referred to herein as attachment features 116). Notably, the mounting surfaces 104 of the firearm, as well as any fastener apertures 115 of the shroud 110 may be threaded or unthreaded. In some embodiments, modifications to the firearm may be required to engage the attachment feature(s) 116 to the mounting surface(s) 104. In other embodiments, existing features of the firearm may be used to engage the attachment features 116 to the mounting surfaces 104, such that modifications to the firearm are unnecessary. In yet other embodiments, a shroud may be connected to a previously non-existent feature of a firearm. For instance, a newly drilled or tapped hole may be created for attached a shroud to a firearm. Notably, regardless of the mechanisms used for coupling the shroud 110 to the firearm 100, the shroud may be configured to allow the firearm's reciprocating mechanism 101 to move freely throughout the reciprocating mechanism's entire cycle even when the shroud is grabbed, pushed against an object (e.g., an attacker), or otherwise manipulated (e.g., by an operator of the firearm, by an attacker, and so forth).

Figure 7:
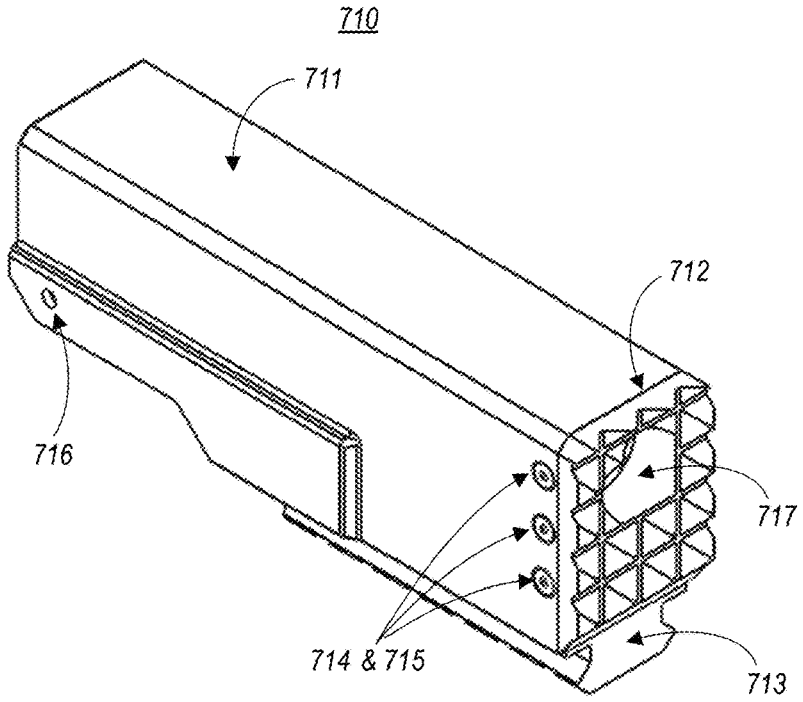
FIG. 7 illustrates an example of a shroud comprising a hood portion, a faceplate portion, and a floorplate portion.

FIG. 7 depicts a perspective view of an assembled shroud 710 that is not connected to a firearm (e.g., the firearm 100). As illustrated, the assembled shroud 710 includes hood 711, faceplate 712, floorplate 713, fasteners 714, fastener apertures 715, and attachment features 716. In some embodiments, the floorplate 713 may extend from the faceplate 712 to a trigger guard (e.g., the trigger guard 106 of the firearm 100 of FIG. 1) of a firearm to which the shroud 710 has been coupled. In other embodiments, the floorplate 713 may cover less than an entirety of a distance between the faceplate 712 and a trigger guard of a firearm to which the shroud 710 is attached. For instance, a floorplate may extend from the faceplate 712 to a location before reaching the trigger guard 106 (i.e., the floorplate is not connected to and/or does not contact the trigger guard, in such embodiments).

Figure 8A:
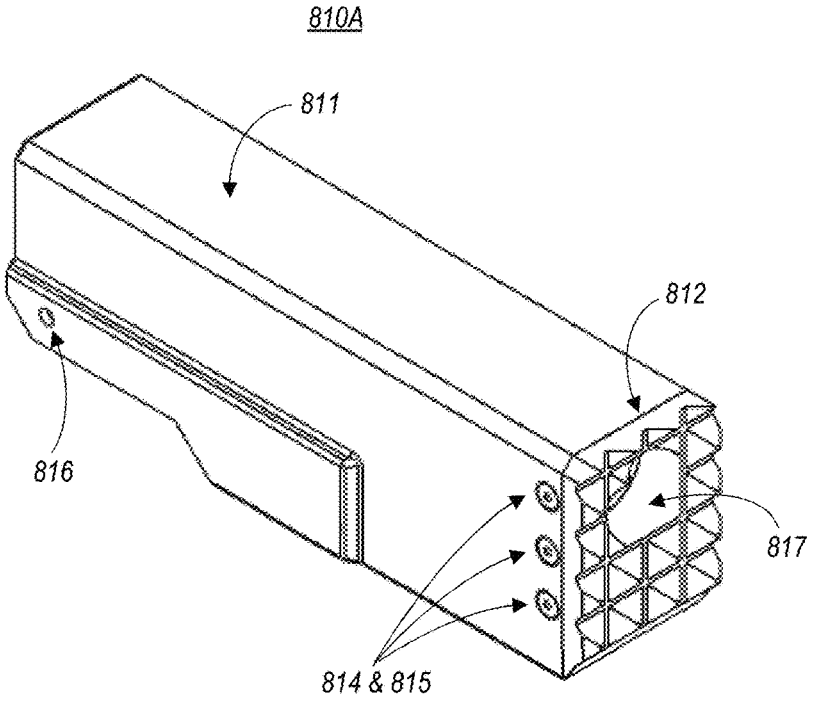
FIG. 8A illustrates an example of a shroud comprising a hood portion and a faceplate portion.
Figure 8B:
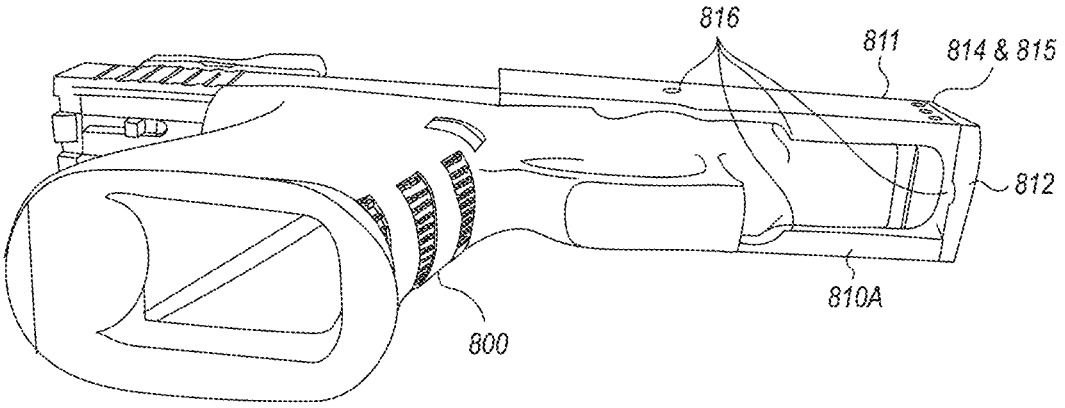
FIG. 8B illustrates an example of a shroud comprising a hood portion and a faceplate portion connected to a cooperating firearm.

FIGS. 8A and 8B illustrate an assembled shroud 810A without a floorplate (e.g., the floorplate 113 of FIG. 1). In particular, FIG. 8A illustrates a top perspective view of the assembled shroud 810A without a floorplate (e.g., the floorplate 113 of FIG. 1) when not coupled to a firearm. As shown, the assembled shroud 810A includes the hood 811, faceplate 812, fasteners 814, fastener apertures 815, and attachment features 816. FIG. 8B illustrates a bottom perspective view of the assembled shroud 810A without a floor plate when coupled to the firearm 800 and shows additional attachment features 816.

Figure 9:
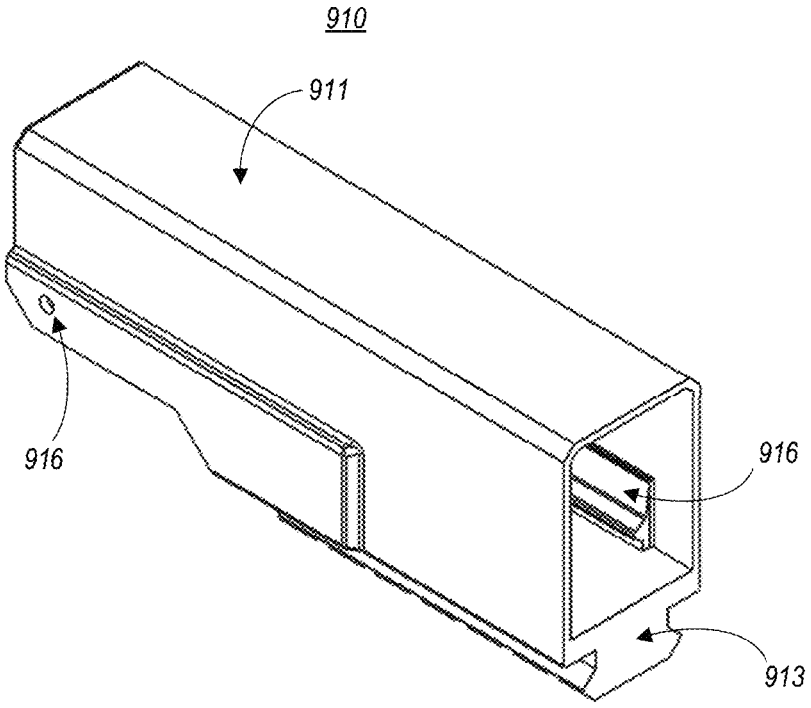
FIG. 9 illustrates an example of a shroud comprising a hood portion and a floorplate portion.

FIG. 9 illustrates a perspective view of a shroud 910 without a faceplate, wherein the shroud 910 comprises the hood 911, the floorplate 913, and the attachment features 916.

Figure 10A:
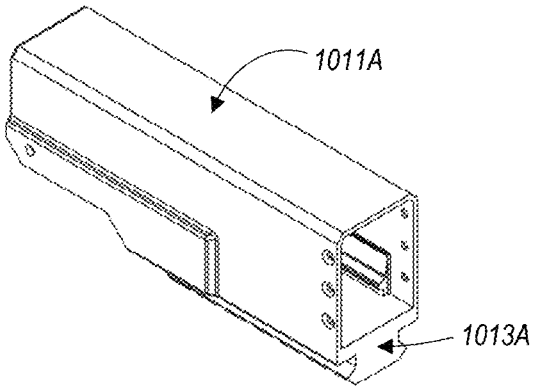
FIG. 10A illustrates an example of a shroud where a hood portion and a floorplate portion are integrated and can accept a faceplate.
Figure 10B:
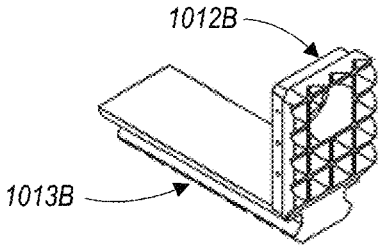
Figure 10C:
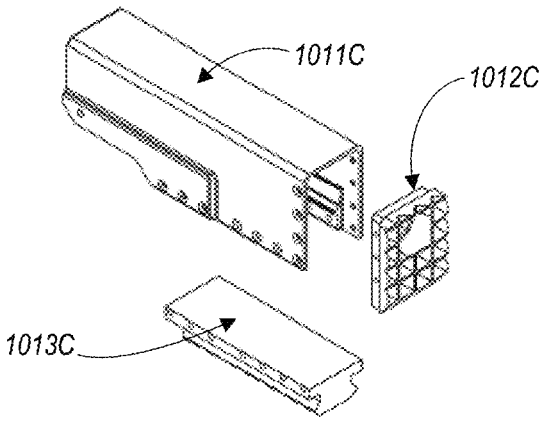
FIG. 10C illustrates an exploded view of a shroud comprising a hood portion, a faceplate portion, and a floorplate portion as separate components.

As briefly described, one or more of a hood, faceplate, and floorplate may be formed as one piece (i.e., forming an integrated shroud). For instance, FIG. 10A depicts a perspective view of a floorplate 1013A that is unitarily formed with a hood 1011A. In another example, FIG. 10B depicts a perspective view of an example of a floorplate 1013B unitarily formed with a faceplate 1012B. In yet another example, FIG. 10C depicts a perspective view of an example of a hood 1011C, a faceplate 1012C, and a floorplate 1013C that are each a separate component/assembly. Other embodiments of a floorplate (e.g., the floorplate 113) may be comprised differently. For instance, a floorplate may be included as part of a shroud, as further described herein. Accordingly, a shroud, as described herein, may include any combination of a hood, a faceplate, a floorplate and other features and fitments. In a specific example, a shroud may comprise a hood without a faceplate or a floorplate. In another example, a shroud may comprise a hood and a faceplate without having a floorplate. In yet another example, a shroud may comprise a hood and a floorplate without having a faceplate.

Figure 11:
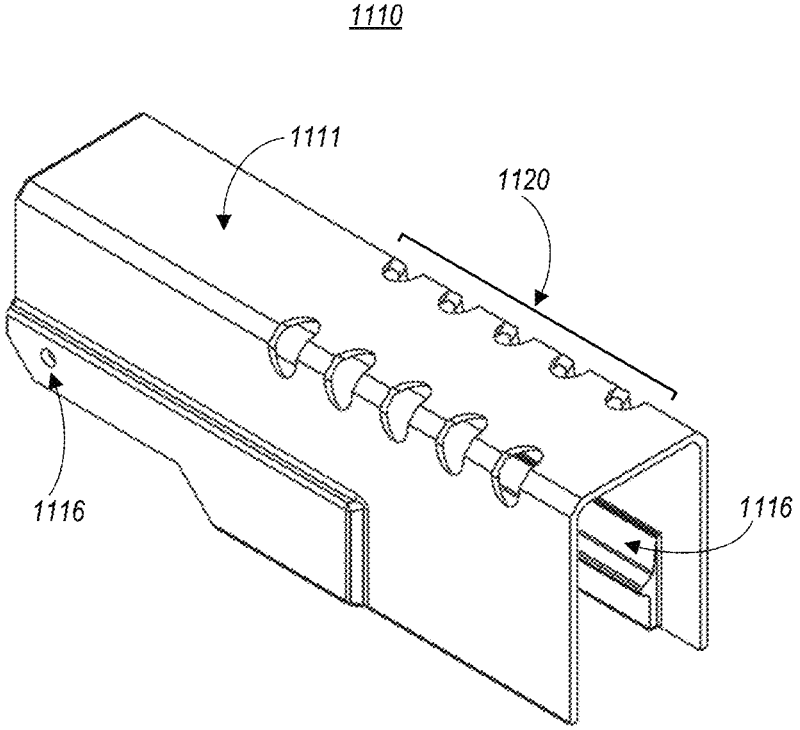
FIG. 11 illustrates an example of a shroud with a weapon enhancement feature.

Regardless of the particular design of a shroud (e.g., whether the shroud has a faceplate, whether the shroud has a floorplate, and so forth), the shroud may provide a structure whereon design features, fitments and/or additional elements can be added that enhance a firearm's traditional utility, and alternatively, its utility as an impacting, piercing, cutting, slicing, gouging, scraping, electrical stunning and/or chemical spraying type of weapon. For instance, FIG. 11 illustrates a perspective view of a shroud 1110 that includes a hood 1111, a weapon enhancement feature 1120, and the attachment features 1116. Such enhancements (e.g., weapon enhancement feature 1120) to any components of a shroud (e.g., the hood 1011C, the faceplate 1012C, the floorplate 1013C of FIG. 10C) may be bored, textured, profiled, elevated, relieved, and so forth.

Figure 12A:
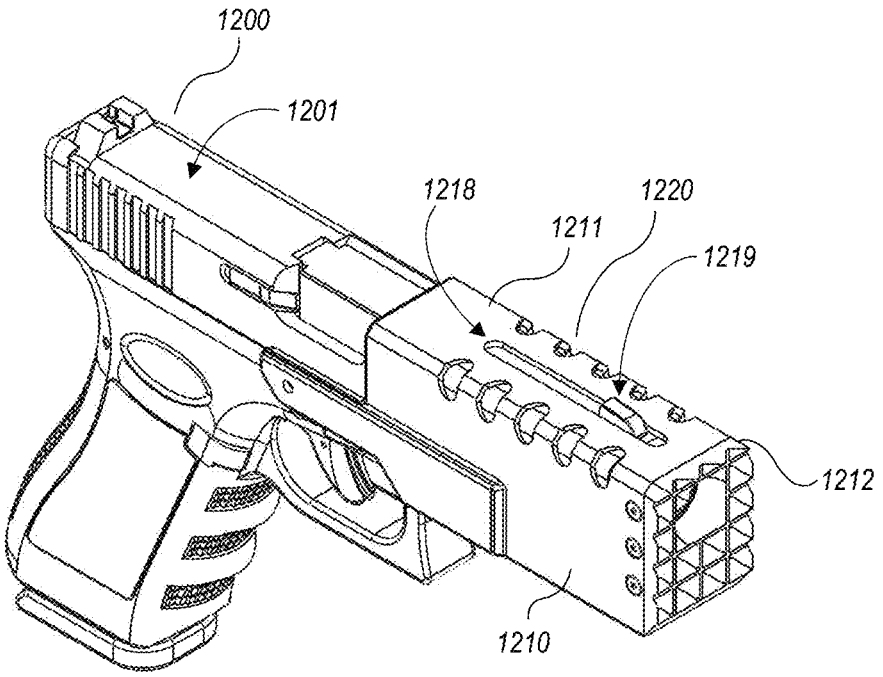
FIG. 12A illustrates an example of a shroud comprising a hood portion and a faceplate portion connected to a cooperating firearm having a reciprocating mechanism in a forward position.

FIG. 12A illustrates a perspective view of a shroud 1210 installed on a firearm 1200 having a reciprocating mechanism 1201 in a forward position and a fitment 1219. Additionally, as illustrated, the shroud 1210 includes a hood 1211, a faceplate 1212, a weapon enhancement feature 1220, and an access feature 1218 that allows the fitment 1219 of the firearm 1200 to move in various positions corresponding to a cycle of the reciprocating mechanism 1201.

Figure 12B:
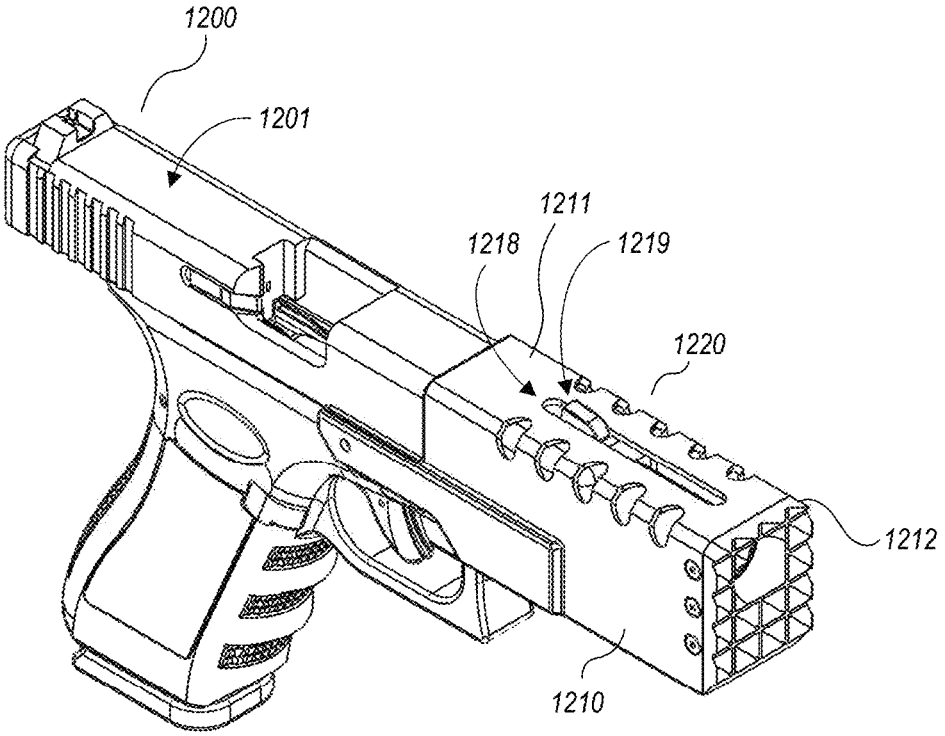
FIG. 12B illustrates an example of a shroud comprising a hood portion and a faceplate portion connected to a cooperating firearm having a reciprocating mechanism in a rearward position.

For instance, FIG. 12B illustrates a perspective view of the shroud 1210 installed on the firearm 1200 when the reciprocating mechanism 1201 is in a rearward position. Accordingly, the shroud 1210 allows the reciprocating mechanism 1201 of the firearm 1200 to move freely throughout an entire cycle of the reciprocating mechanism 1201 by providing a protective barrier that surrounds all or part of the reciprocating mechanism and any attachments thereto (e.g., "red-dot" sights, charging handles, quick release levers, and so forth). Using a shroud in this way reduces the possibility of the reciprocating mechanism 1201 and any attachments thereto being contacted by objects, structures, body parts, and so forth that might cause the reciprocating mechanism 1201 to move out-of-battery (i.e., other than through its normal cycling) or restrict the complete cycling of the reciprocating mechanism 1201 in any way.

Notably, various embodiments of shrouds, as described herein, may vary in the amount of protection they provide to a firearm's reciprocating mechanism 1201, based on an intended purpose and/or use of the firearm 1200. For instance, in some embodiments, the shroud 1210 may be shorter, offer less coverage to the reciprocating mechanism 1201, and/or have one or more openings (e.g., the access feature 1218) because the intended purpose and/or use of the firearm 1200 prioritizes size, weight and/or other features of the firearm 1200. In other embodiments, a shroud 1210 may be longer, offer more coverage to the reciprocating mechanism 1201, and/or have fewer openings (e.g., the access feature 1218) because the intended purpose and/or use of the firearm 1200 prioritizes protecting the firearm's ability to function (i.e., more fully ensuring that the reciprocating mechanism is not impeded from completing an entire cycle) over other considerations.

Figure 13A:
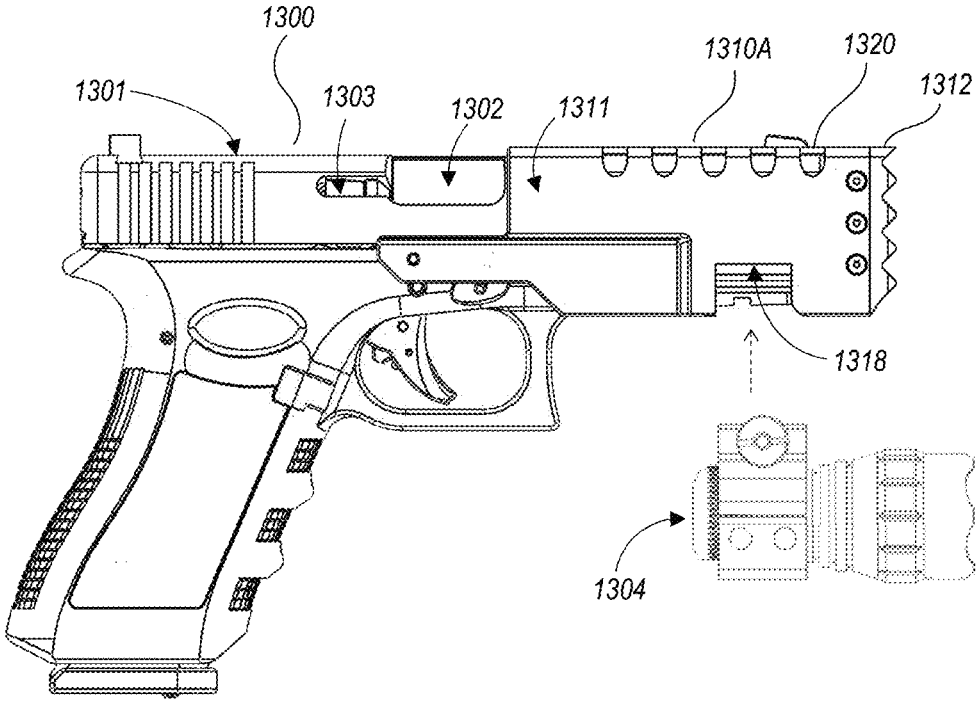
FIGS. 13A and 13B each illustrate a side view of an example shroud connected to a cooperating firearm, showing one way an accessory (i.e., a light) may be attached to the firearm.
Figure 13B:
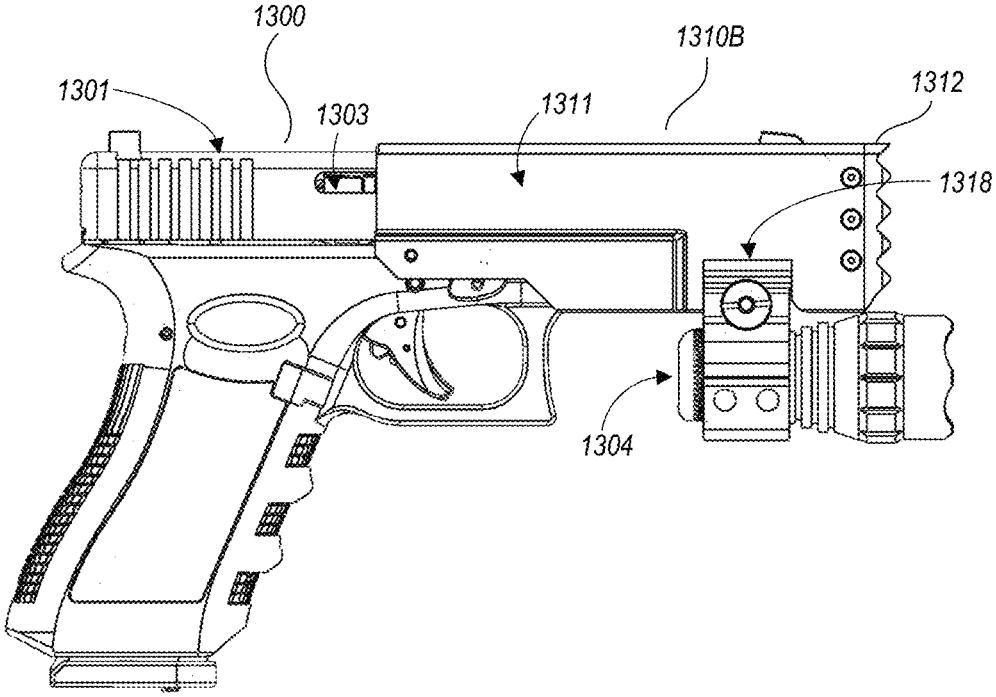

FIGS. 13A and 13B each illustrate a side view of a shroud installed on a cooperating firearm and a cooperating accessory (i.e., a light 1304). For instance, FIG. 13A includes a firearm 1300 having a reciprocating mechanism 1301, an extractor 1303, and an ejection port 1302, as well as a one example of a cooperating shroud 1310A that includes a hood 1311 and an access feature 1318 that is configured such that the light 1304 may be coupled to the firearm 1300 concurrently with the shroud 1310. Notably, the shroud 1310A is relatively short, such that the shroud 1310A does not cover the ejection port 1302 of the firearm 1300 when the reciprocating mechanism 1301 is in a forward position. Additionally, the shroud 1310A includes a weapon enhancement feature 1320.

As illustrated, FIG. 13B also includes a firearm 1300 having a reciprocating mechanism 1301, an extractor 1303, with another example of a cooperating shroud 1310B that includes a hood 1311 and an access feature 1318 that is configured such that the light 1304 is coupled to the firearm concurrently with the shroud 1310B. In this example, the shroud 1310B is longer than the shroud 1310A, such that the shroud 1310B covers the ejection port of the firearm 1300 when the reciprocating mechanism 1301 of the firearm 1300 is in a forward position.

In some embodiments, the hood 1311 (or any hood described herein) may also include features that extend and/or widen the bottom of the hood to allow an accessory (e.g., the light 1304) to be attached to the firearm concurrently with the shroud but does not require one or more access features (e.g., the access feature 1318). Accordingly, the access feature 1318 may comprise a feature of the firearm 1300, such that either or both of a shroud (e.g., the shroud 1310A, the shroud 1310B, and so forth) and an accessory (e.g., the light 1304) may be connected to the firearm 1300. As further described herein, a shroud (e.g., the shroud 1310A, the shroud 1310B, and so forth) may include access features 1318 that allow accessories to be coupled to the shroud (e.g., the shroud 1310A, the shroud 1310B, and so forth).

Figure 14:
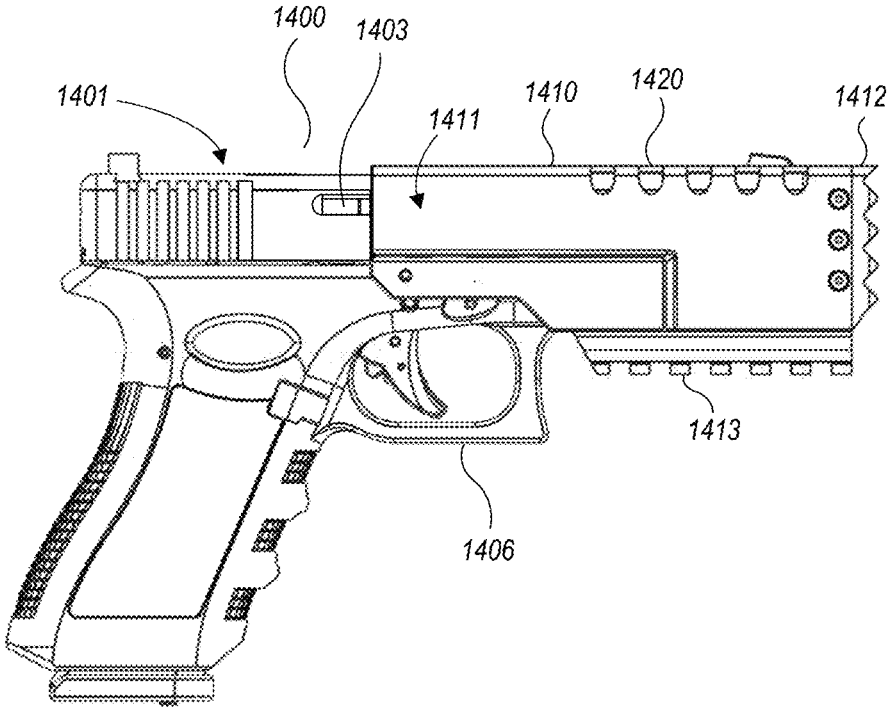
FIG. 14 illustrates an example of an extended shroud comprising a hood portion, a faceplate portion, and a floorplate portion coupled to a firearm.

FIG. 14 depicts a side view of a shroud 1410 installed on a cooperating firearm 1400. As shown, the shroud 1410 includes a hood 1411, a faceplate 1412, a floorplate 1413, and a weapon enhancement feature 1420. Notably, the hood 1411 of the shroud 1410 covers the ejection port of the firearm 1400. Additionally, the floorplate 1413 is shown as extending from the faceplate 1412 to a location that is before the trigger guard 1406, such that the floorplate 1413 does not touch and/or is not connected to the trigger guard 1406.

Figure 15:
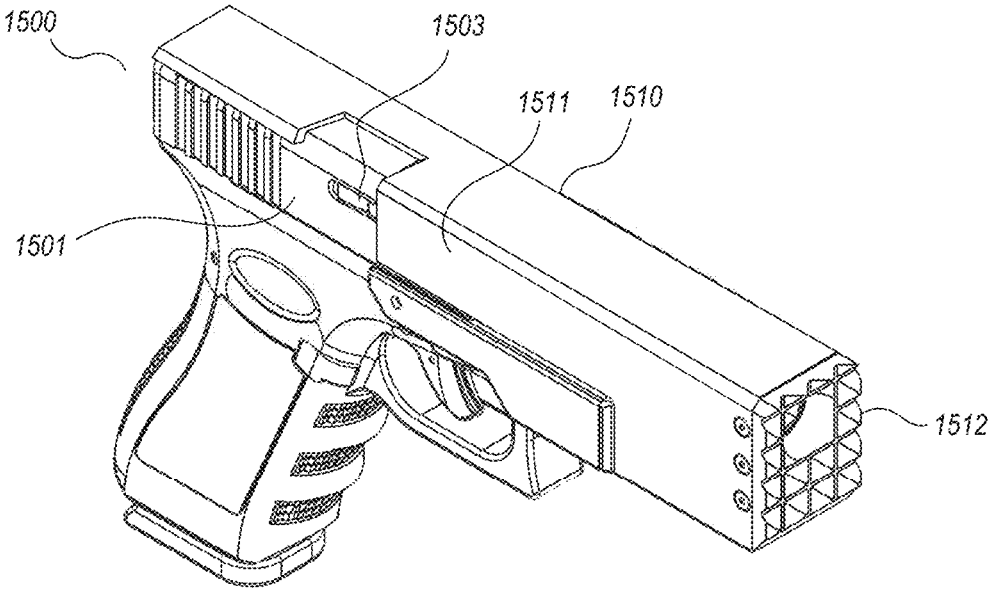
FIG. 15 illustrates another example of an extended shroud comprising a hood portion and a faceplate portion connected to a cooperating firearm with no fitments.

FIG. 15 illustrates a firearm 1500 having a reciprocating mechanism 1501, as well as a cooperating shroud 1510 that includes a hood 1511 and a faceplate 1512. Notably, the shroud 1510 is relatively long on each side of the firearm 1500 and has a top portion of the shroud 1510 extending to the furthermost back portion of the firearm 1500. Additionally, the shroud 1510 covers the ejection port (when the reciprocating mechanism is in the forward position). In some embodiments, hoods 1511 that cover areas of a firearm 1500 to the rear of the ejection port 1302 (with respect to FIG. 13A) of a firearm 1500, may include an access feature that allows ammunition components to be ejected from the firearm 1500. Accordingly, FIGS. 2B, 2C, 8B, 12A, 13A, 13B, 14, 15 and so forth illustrate examples of shrouds installed on cooperating firearms with the reciprocating mechanism in the forward position. These embodiments show, among other things, shrouds with hoods of varying lengths, illustrating some comparative differences in the amount of protective coverage which can be provided by different shrouds. Notably, while particular examples are described with respect to the figures herein, virtually unlimited lengths and types of shrouds may be created and utilized by one of skill in the art by practicing the principles described herein.

Figure 16:
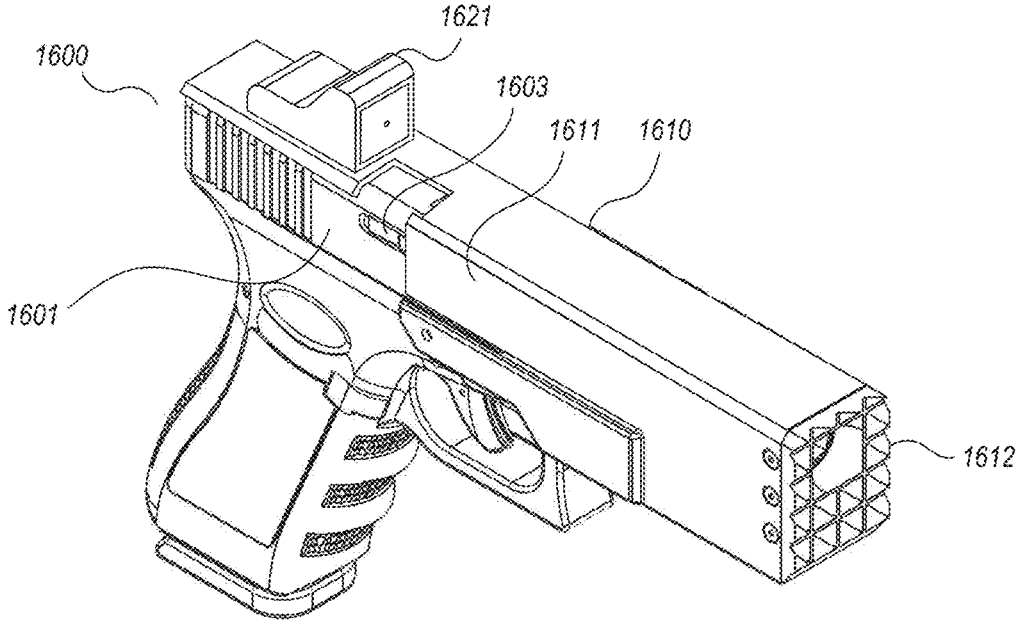
FIG. 16 illustrates an example of an extended shroud having a fitment connected to the shroud.

FIG. 16 illustrates a firearm 1600 having a reciprocating mechanism 1601, as well as a cooperating shroud 1610 that includes a hood 1611 and a faceplate 1612. Similar to the shroud 1510 of FIG. 15, the shroud 1610 is relatively long on each side of the firearm 1600 and has a top portion of the shroud 1610 extending to a furthermost back portion of the firearm 1600. Additionally, the shroud 1610 may include an attachment mechanism (not shown) that allows for attaching one or more fitments (e.g., a sight). In particular, FIG. 16 illustrates a sight 1621 (e.g., a "red-dot" sight) that has been attached to the shroud 1610. Accordingly, any of the shrouds described herein may include one or more attachment mechanisms that allow for coupling one or more fitments. In other embodiments, any of the shrouds described herein may include one or more features built into (e.g., molded, extruded, milled, welded, peened, etc.) the shroud, as part of the shroud.

Figure 17:
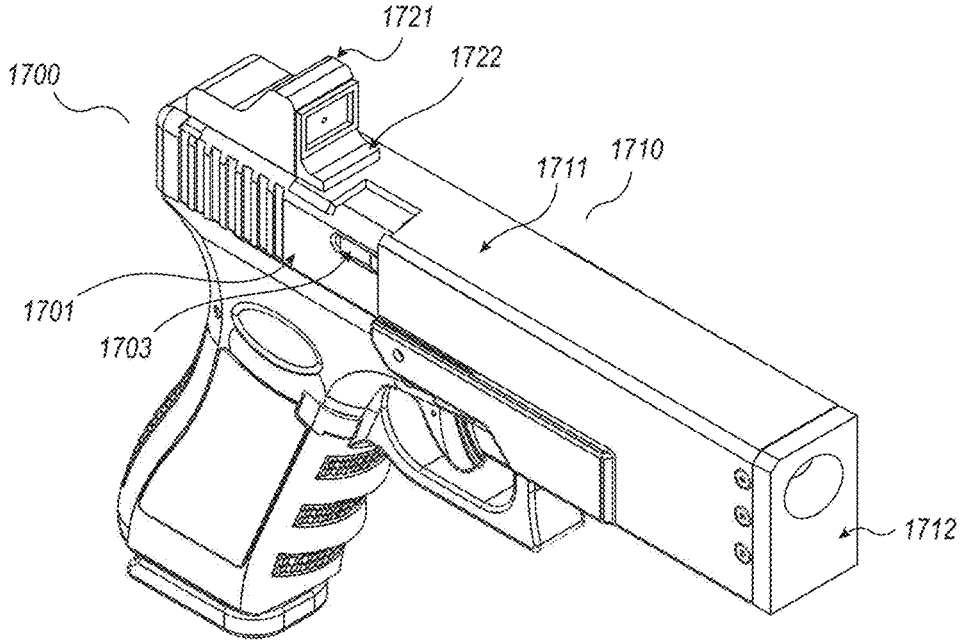
FIG. 17 illustrates an example of an extended shroud having a fitment connected to the reciprocating mechanism of a firearm.

FIG. 17 illustrates a firearm 1700, as well as a cooperating shroud 1710 that includes a hood 1711 and a faceplate 1712. Unlike the shroud 1610 of FIG. 16, the shroud 1710 is shorter on top portion of the firearm 1700. In this embodiment, the fitment 1721 (e.g., a "red-dot" sight) is coupled to the firearm's reciprocating mechanism 1701. A separate fitment 1722, is attached to the shroud 1710 to prevent a person, or object from moving the reciprocating mechanism 1701 out-of-battery or preventing it from cycling completely by coming in contact with the sight 1721. As shown, the fitment 1722 (i.e., a frame-like protrusion) protects the reciprocating mechanism 1701, but also allows for use of the sight 1721. This is just one example of a fitment 1722 that may be attached to a shroud 1710 to provide protection to the reciprocating mechanism 1701 or any fitments 1721 attached to the reciprocating mechanism 1701. The fitment 1722 may be integrated with the shroud 1710 (i.e., the fitment and shroud forming a single component) or may detachable from the shroud.

Figure 18A:
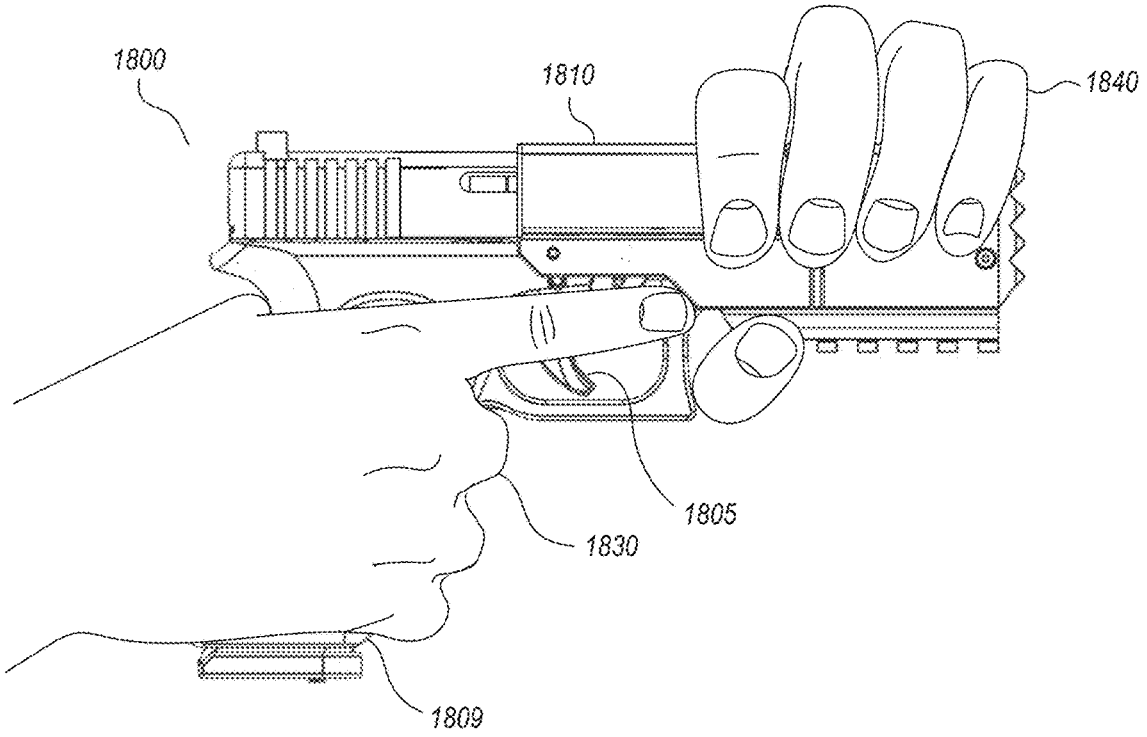
FIGS. 18A and 18B illustrate examples of different two-handed grips that are possible on a firearm having a connected shroud.
Figure 18B:
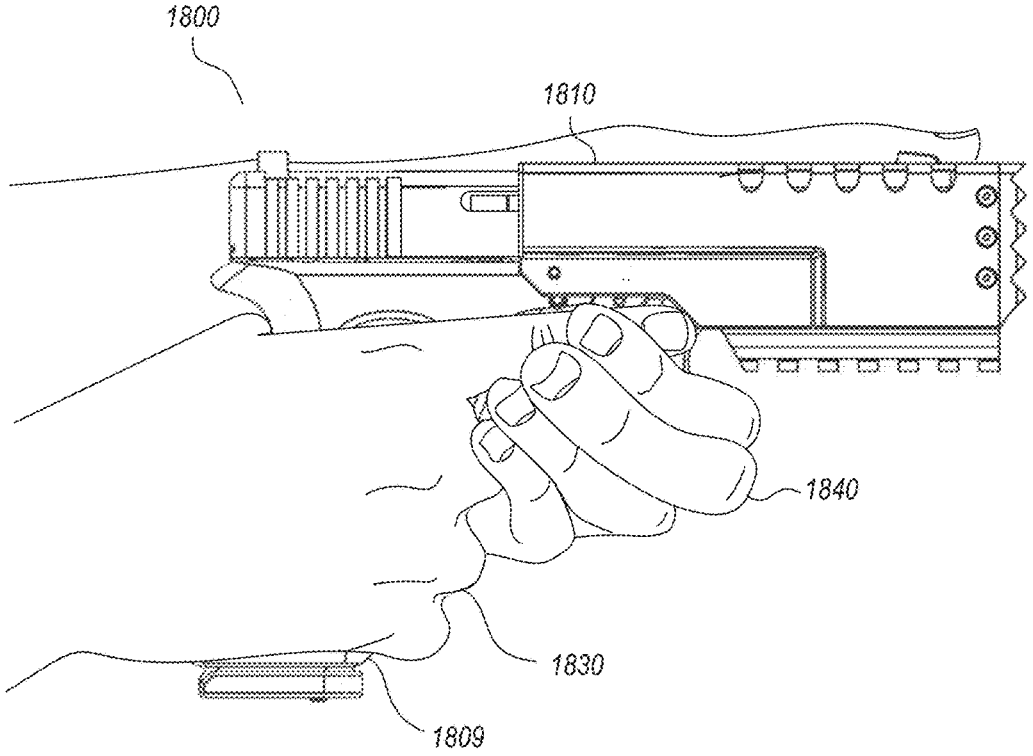

FIGS. 18A and 18B each illustrate a different example of an alternative two-handed grip of a firearm 1800 having a cooperating shroud 1810. As shown, a "firing" hand 1830 is gripping the firearm 1800 at a lower frame (i.e., the pistol grip) 1809 of the firearm 1800 (i.e., the hand being positioned as it traditionally is to operate the trigger 1805). Additionally, FIGS. 18A and 18B show the operator's support hand 1840 gripping the shroud. Such grips, are afforded by the shroud 1810 and allow an operator of the firearm 1800 to better control recoil, improve his/her ability to aim accurately, increase the rate at which he/she can fire effectively, improve his/her ability to retain control of the firearm during a scuffle with an attacker and maintain a more defensive body structure to fend off attacks from an attacker. As a result of the shroud's unique features and functionality, an operator of the firearm 1800, with a shroud 1810, has a higher chance of surviving a potentially lethal attack by combining sustainable and controlled rapid fire with certain martial arts type "hand-to-hand" techniques. Moreover, this gives the operator the option of using less-lethal defensive techniques, rather than having only one option of firing the firearm 1800.

Figure 19A:
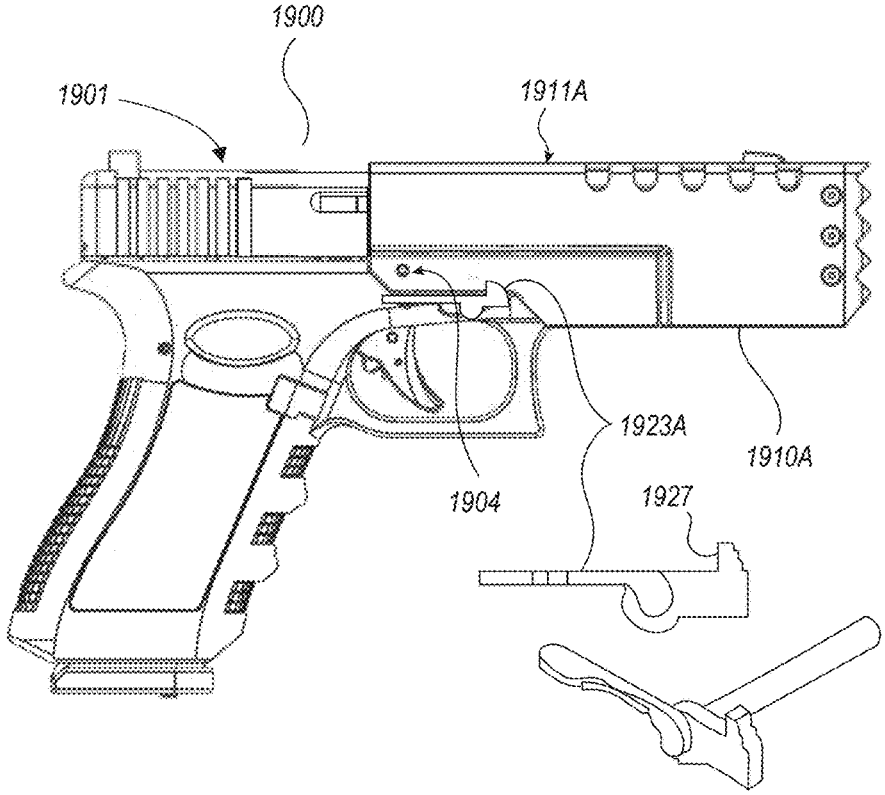
FIG. 19A illustrates an example shroud comprising a one-piece hood portion and a faceplate portion and having a mechanism for quickly releasing a shroud from a cooperating firearm.
Figure 19B:
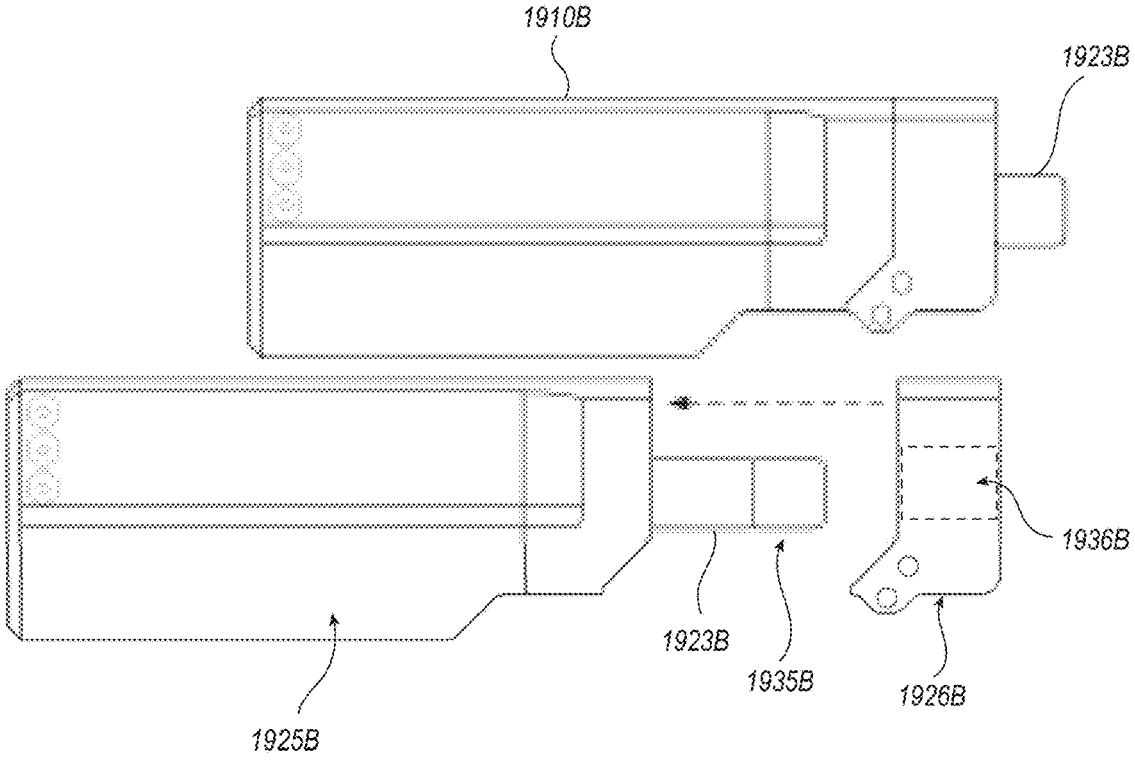
FIG. 19B illustrates an example shroud comprising a two-piece hood portion and a faceplate portion and having a mechanism for quickly releasing the greater portion of the shroud from the lesser portion of the shroud and a cooperating firearm.

FIGS. 19A and 19B illustrate different example embodiments of shrouds 1910A and 1910B, respectively, that include mechanisms 1923A and 1923B for quickly releasing all or part of a shroud connected to a firearm (e.g., the firearm 1900). In particular, FIG. 19A illustrates a shroud 1910A with a one-piece hood portion 1911A coupled to a cooperating firearm 1900 having a reciprocating mechanism 1901. As illustrated, the shroud 1910A of FIG. 19A includes a quick release mechanism 1923A that includes a spring-loaded lever which, when rotated such that the flat surface 1927 of the quick release mechanism is moved away from the cooperating surface of the shroud, the entire shroud 1910A can be quickly released from a firearm 1900. FIG. 19A implies that certain other mounting surfaces 104 of FIG. 1 and fasteners 114 of FIG. 1 would not be used in such an embodiment Whereas FIG. 19A illustrates the shroud 1910A having a one-piece hood 1911A, FIG. 19B illustrates another embodiment of a shroud 1910B having a quick release mechanism 1923B. Notably, the shroud 1910B, as illustrated in 19B, may comprise two or more distinct portions that are shown as being connected to each other (e.g., via a button, lever, cam, and so forth). In such embodiments, the quick release mechanism 1923B may allow for disconnecting a first portion 1925B of the shroud 1910B from a second portion 1926B of the shroud 1910B, thus separating a portion 1925B of the shroud 1910B being grabbed by an attacker from the firearm 1900. Accordingly, shrouds as described herein may comprise one or more parts (e.g., the first portion 1925B with a "male" connector part 1935B and the second portion 1926B with a "female" receiver part 1936B) in conjunction with a quick release mechanism (e.g., the quick release mechanism 1923B. Again, while only a single example of a shroud 1910B having two distinct portions in conjunction with a quick release mechanism 1923B is illustrated, virtually unlimited types of multi-portion shrouds having a quick release mechanism would be understood by one of ordinary skill in the art. Notably, such quick release mechanisms (i.e., 1923A and 1923B) may be particularly beneficial if an attacker is grabbing an individual's firearm 1900 with a shroud 1910A, 1910B or some other shroud with similar functionality attached to it. In such circumstances, the quick release mechanisms 1923A and 1923B may allow the firearm operator to quickly separate the shroud from the firearm (e.g., via a button, lever, cam, and so forth) allowing the operator to create distance from an attacker and better engage an attacker with the freed firearm 1900.

Figure 20B:
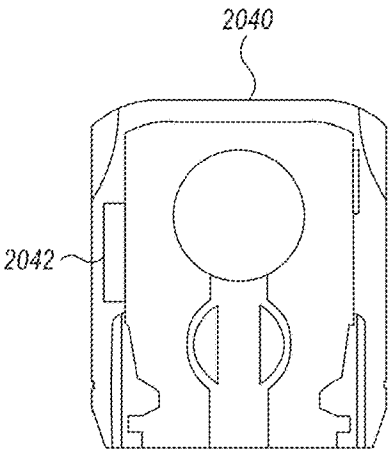
FIG. 20B illustrates a rear view of an example shroud comprising a two-piece hood portion and a faceplate portion and having a mechanism for quickly releasing a shroud from a cooperating firearm.
Figure 20A:
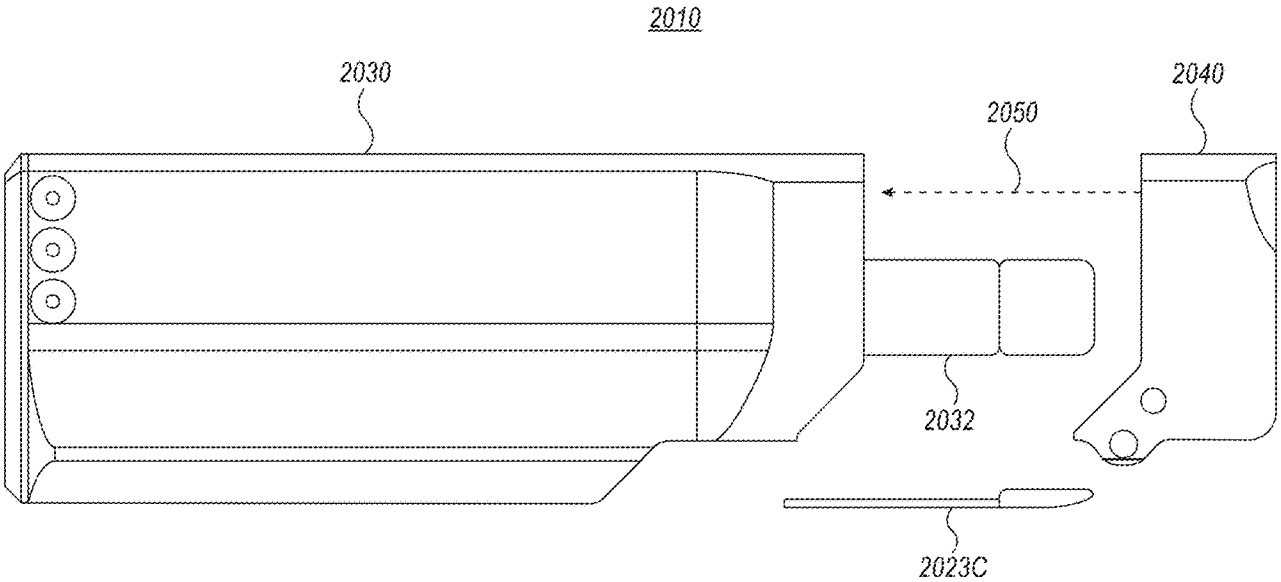
FIG. 20A illustrates an exploded side view of an example shroud comprising a two-piece hood portion and a faceplate portion and having a mechanism for quickly releasing a shroud from a cooperating firearm.

FIGS. 20A and 20B illustrate a more specific example embodiment of a shroud 2010 that includes two distinct shroud portions and a quick release mechanism for quickly releasing the shroud 2010 from a firearm (e.g., the firearm 100). As illustrated, FIG. 20A illustrates a shroud 2010 having a first portion 2030, a second portion 2040, a connection portion 2032, and a quick release mechanism 2023. As illustrated by arrow 2050, the first portion 2030 and the second portion 2040 of the shroud 2010 may be coupled to each other (as well as to a firearm). In particular, FIG. 20B illustrates a receiving portion 2042 within the second portion 2040 that is configured to receive the connection portion 2032 of the first portion 2030. The quick release mechanism 2032 is configured to allow for quick release of the first portion 2030 from the second portion 2040, and ultimately, to allow for quick release/removal of the shroud 2010 from a connected firearm. Accordingly, shrouds as described herein may comprise two distinct parts (e.g., the first portion 2030 and the second portion 2040) in conjunction with a quick release mechanism (e.g., the quick release mechanism 2023) that allow for quickly releasing a shroud from a connected firearm. Again, while only a single shroud having two distinct portions in conjunction with a quick release mechanism is illustrated, virtually unlimited types of two-portion shrouds having a quick release mechanism would be understood by one of ordinary skill in the art.

Materials for the elements, components, and assemblies described herein may include, but are not limited to, steels, metal alloys, aluminums, fiberglass, graphite, hard composites, and so forth for various embodiments generally intended for use with "live" firearms (i.e., firearms generally used for military, law enforcement, security, personal defense, sport, competition shooting, recreational shooting, and so forth). Additionally, materials used for practicing the principles described herein may be configured to beneficially distribute weight on a firearm to provide stability over the perceived recoil created when firing the firearm. Notably, other materials for the elements, components, and assemblies described herein may include, but are not limited to, wood, rubber, foam, soft composites, and so forth for various embodiments intended for use with "inert" firearms (i.e., firearms generally used for training, practice, gaming, playing, and so forth). Furthermore, a shroud may be an integral part of a firearm frame or chassis as a part of the firearm's design during its original manufacturing. As such, a shroud may be physically integrated into the actual physical firearm.

Turning now to holsters, holsters are generally designed and created to fit a specific make and model of firearm, with or without certain accessories (e.g., one holster may be particularly designed for a GLOCK® 19 with a SUREFIRE® 300X light, another holster may be particularly designed for a SMITH & WESSON® M&P® 9 with no light, and so forth). However, the external geometry and design of the shrouds described herein allows multiple firearm makes and models to be secured by the same holster. In particular, utilizing a shroud as described herein may allow for maintaining the same geometry and design even when the shroud is used with various different types of firearms, thus allowing use of a single holster design for a variety of different types of firearms when using the shroud.

Moreover, the geometry and design features of the shrouds described herein may provide additional surface area for connecting to a holster, thus offer improved retention capabilities in holsters designed for the shrouds. Firearms coupled to shrouds described herein may utilize holsters of varying retention levels. For instance, level 1 holsters (i.e., friction), level 2 holsters (i.e., friction plus a mechanical release), and level 3 holsters (i.e., friction plus a mechanical release and an exterior cover) may be utilized when practicing the principles described herein. Improved retention in holsters designed to receive the geometry of a firearm with a shroud may better prevent individuals other than the firearm operator from accessing a firearm from such a holster and provide additional safety to operators when carrying and deploying firearms with a shroud. Furthermore, a shroud with a compatible holster maintains the firearm operator's ability to conceal a firearm in cases where that is desired and allows for fast and easy access to the firearm.

Accordingly, a shroud that can be coupled to a firearm may address numerous issues and scenarios related to firearms with reciprocating mechanisms. For instance, the shroud may prevent a reciprocating mechanism of a firearm from being moved out-of-battery (i.e., resulting in an inability to fire the firearm) or otherwise restricting the firearm from cycling completely in numerous scenarios. In an example, a shroud may prevent an attacker from grabbing the reciprocating mechanism in such a way that causes the reciprocating mechanism to move out-of-battery or become unable to complete its cycle. In another example, a shroud may prevent a reciprocating mechanism from being fouled by debris or other obstructions that might enter or interfere with critical areas of the firearm (e.g., ejection port, extractor, levers, and so forth). In yet another example, a shroud may prevent a reciprocating mechanism from moving out-of-battery when a muzzle of the firearm is pressed against an object. In addition, such shrouds may also beneficially distribute weight on a firearm to provide stability in response to perceived recoil created in response to firing the firearm.

Moreover, a shroud may add weapon features that are separate from firing a firearm, including features that may be effective when using the firearm for impacting, piercing, cutting, slicing, gouging, scraping, electrical stunning and/or chemical spraying, and so forth. A firearm having a coupled shroud may also be utilized with a variety of two-handed grip that allows for additional control. Similarly, the shrouds described herein may be configured to reduce the amount of perceived recoil associated with firing the firearm by redirecting gases exiting the firearm when it is fired. Quick release mechanisms may also be included with any shroud, such that the shroud may be easily and quickly separated from a firearm. Holsters may also be created where one holster specifically designed to retain the geometry of a shroud can be used in conjunction with a wide variety of firearms with a shroud as described herein. Furthermore, a shroud may also provide additional surface area and ultimately better retention of a firearm when it is being carried in a holster.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An apparatus for an integrated component of a handgun, comprising:

a shroud that is configured to directly affix to a frame of the handgun through at least one fastener, the shroud being further configured to:

cover at least a portion of a reciprocating mechanism of the handgun, and allow the reciprocating mechanism to move freely through an entire cycle of the reciprocating mechanism while the shroud remains directly affixed to the frame;

the shroud comprising a hood portion that extends at least to an end of a muzzle of the handgun, wherein the hood portion comprises a box-shaped enclosure that encloses the reciprocating mechanism on at least three sides when the shroud is attached to the handgun, and the shroud is configured to be retained in a holster which holster is separate from the shroud.

2. The apparatus of claim 1, wherein the shroud further includes a faceplate that is coupled to the hood portion and extends beyond the muzzle of the handgun.

3. The apparatus of claim 2, wherein the faceplate is detachable from the hood portion.

4. The apparatus of claim 2, wherein the faceplate is integrated with the hood portion, such that the faceplate and the hood portion comprise a single entity.

5. The apparatus of claim 2, wherein the shroud further includes a floorplate that is coupled to at least one of the hood portion and the faceplate.

6. The apparatus of claim 5, wherein the floorplate does not connect to a trigger guard of the handgun.

7. The apparatus of claim 1, wherein the shroud completely covers the reciprocating mechanism from at least an ejection port of the handgun to the end of the muzzle of the handgun.

8. The apparatus of claim 1, wherein the shroud is configured to receive one or more attachments.

9. An apparatus, comprising:

a shroud that is configured to directly affix to a frame of a firearm through at least one fastener, the firearm comprising: the frame, a reciprocating mechanism, and a muzzle, the shroud being further configured to:

completely cover at least a portion of the reciprocating mechanism of the firearm from at least an ejection port of the firearm to the end of the muzzle of the firearm, and allow the reciprocating mechanism to move freely through an entire cycle of the reciprocating mechanism while the shroud remains directly affixed to the frame, wherein the shroud includes:

a hood portion that covers at least a portion of the reciprocating mechanism, wherein the hood portion comprises a box-shaped enclosure that encloses the reciprocating mechanism on at least three sides when the shroud is attached to the firearm;

a faceplate that is coupled to directly to the hood portion, the faceplate extending beyond the muzzle of the firearm; and the shroud is configured to be retained in a holster which holster is separate from the shroud.

10. The apparatus of claim 9, wherein the faceplate is detachable from the hood portion.

11. The apparatus of claim 9, wherein the faceplate is integrated with the hood portion, such that the faceplate and the hood portion comprise a single entity.

12. The apparatus of claim 9, wherein the shroud further includes a floorplate that is coupled to at least one of the hood portion and the faceplate.

13. The apparatus of claim 12, wherein the floorplate does not connect to a trigger guard of the firearm.

14. The apparatus of claim 9, wherein the shroud does not include a floorplate.

15. The apparatus of claim 9, wherein the shroud is configured to receive one or more attachments.

16. The apparatus of claim 15, wherein at least one of the one or more attachments comprises at least one of a sight, a light, or a laser.

17. An apparatus, comprising:

a shroud that is configured to directly affix to a frame of a firearm through a fastener, the firearm comprising: the frame, a reciprocating mechanism, and a muzzle, the shroud being further configured to:

cover at least a portion of the reciprocating mechanism of the firearm, and allow the reciprocating mechanism to move freely through an entire cycle of the reciprocating mechanism while the shroud remains directly affixed to the frame, wherein the shroud includes:

a hood portion that covers at least a portion of the reciprocating mechanism wherein the hood portion comprises a box-shaped enclosure that encloses the reciprocating mechanism on at least three sides when the shroud is attached to the firearm;

a faceplate that is coupled directly to the hood portion, the faceplate extending beyond the muzzle of the firearm;

a floorplate that is coupled directly to at least one of the hood portion or the faceplate portion or the firearm; and the shroud is configured to be retained in a holster which holster is separate from the shroud.

18. The apparatus of claim 17, wherein the shroud completely covers the external reciprocating mechanism from at least an ejection port of the firearm to the end of an muzzle of the firearm.

* * * * *